US011684119B2

(12) United States Patent
Cross et al.

(10) Patent No.: US 11,684,119 B2
(45) Date of Patent: Jun. 27, 2023

(54) ARTICLE OF FOOTWEAR AND METHOD OF MANUFACTURING AN ARTICLE OF FOOTWEAR

(71) Applicant: NIKE, Inc., Beaverton, OR (US)

(72) Inventors: Tory M. Cross, Portland, OR (US); Cassidy R. Levy, West Linn, OR (US)

(73) Assignee: NIKE, Inc., Beaverton, OR (US)

( * ) Notice: Subject to any disclaimer, the term of this patent is extended or adjusted under 35 U.S.C. 154(b) by 283 days.

(21) Appl. No.: 16/679,560

(22) Filed: Nov. 11, 2019

(65) Prior Publication Data

US 2020/0205515 A1 Jul. 2, 2020

Related U.S. Application Data

(60) Provisional application No. 62/785,438, filed on Dec. 27, 2018.

(51) Int. Cl.
*A43B 13/28* (2006.01)

(52) U.S. Cl.
CPC ..... *A43B 13/28* (2013.01)

(58) Field of Classification Search
CPC ..... A43B 13/28
See application file for complete search history.

(56) References Cited

U.S. PATENT DOCUMENTS 2,907,058 A 10/1959 Evins
3,680,527 A 8/1972 Barker et al.
4,592,154 A 6/1986 Oatman
4,785,557 A 11/1988 Kelley et al.
5,433,022 A 7/1995 Lo et al.
5,469,639 A 11/1995 Sessa
5,918,385 A 7/1999 Sessa
6,052,921 A 4/2000 Oreck
6,115,945 A * 9/2000 Ellis, III ..... A43B 13/04 36/102
6,295,744 B1 10/2001 Ellis, III
D561,438 S 2/2008 Belley
7,631,440 B2 * 12/2009 Keen ..... A43C 11/00 36/50.1

(Continued)

FOREIGN PATENT DOCUMENTS

EP 3131745 A1 2/2017
TW 284974 9/1996

(Continued)

*Primary Examiner* — Jila M Mohandesi
(74) *Attorney, Agent, or Firm* — Quinn IP Law

(57) ABSTRACT

An article of footwear includes a sole structure and a guide secured to the inner surface of the sole structure. An outer surface of the bottom of an upper is secured to the inner surface of the sole structure, the upper and the guide forming a passage. A tensioning component extends along the guide in the passage, and extends out of the passage at a medial side and/or a lateral side of the upper. An increase in tension in the tensioning component flexibly conforms the sole structure to a foot disposed in the upper. A method of manufacturing the article of footwear includes placing an upper on a last, applying adhesive on an inner surface of a sole structure, placing a guide on the adhesive, the tensioning component on the guide, and the inner surface of the sole structure against an outer surface of the upper.

13 Claims, 20 Drawing Sheets

(56) References Cited

U.S. PATENT DOCUMENTS 8,266,827 B2 * 9/2012 Dojan ..... A43B 23/025 36/50.1
8,656,613 B2 2/2014 Stockbridge et al.
8,875,418 B2 * 11/2014 Long ..... A43B 23/0265 36/50.1
9,009,988 B2 * 4/2015 Jacobs ..... A43B 13/141 36/28
9,609,917 B2 * 4/2017 Dojan ..... A43B 3/26
9,713,362 B2 * 7/2017 Farris ..... A43B 13/41
9,717,303 B2 8/2017 Walker et al.
9,788,609 B2 * 10/2017 James ..... A43C 11/002
9,801,426 B2 10/2017 Cooper
9,943,134 B2 * 4/2018 Holmes ..... A43B 13/36
2004/0181972 A1 * 9/2004 Csorba ..... A43B 23/0265 36/50.1
2005/0076536 A1 4/2005 Hatfield et al.
2005/0262739 A1 12/2005 McDonald et al.
2006/0032086 A1 2/2006 Ellis, III
2008/0229617 A1 9/2008 Johnson et al.
2009/0044432 A1 2/2009 O'Connor et al.
2010/0269271 A1 10/2010 Kim et al.
2010/0269376 A1 10/2010 Flannery et al.
2011/0047832 A1 3/2011 O'Mary
2011/0214313 A1 9/2011 James et al.
2012/0240428 A1 * 9/2012 Knoll ..... A43B 5/0427 36/50.1
2013/0152428 A1 6/2013 Bishop et al.
2014/0013624 A1 * 1/2014 Stockbridge ..... A43B 13/181 36/103
2014/0015169 A1 1/2014 Wan et al.
2014/0041261 A1 2/2014 Walker et al.
2014/0130270 A1 * 5/2014 Baudouin ..... D04B 1/22 12/142 R
2014/0196311 A1 7/2014 Follet et al.
2014/0223779 A1 8/2014 Elder
2014/0259744 A1 9/2014 Cooper
2014/0283412 A1 * 9/2014 Elder ..... A43B 13/127 36/102
2015/0040431 A1 2/2015 Woodman et al.
2015/0089839 A1 * 4/2015 James ..... A43C 11/006 36/102
2015/0089841 A1 4/2015 Smaldone et al.
2015/0128452 A1 5/2015 Hull et al.
2016/0029746 A1 2/2016 Rushbrook
2017/0099907 A1 4/2017 Cin
2017/0202310 A1 7/2017 Spanks et al.
2017/0251761 A1 9/2017 Cin et al.
2017/0265574 A1 9/2017 Beers et al.
2017/0280822 A1 10/2017 Langvin et al.
2018/0125155 A1 5/2018 Kirupanantham et al.
2018/0368517 A1 12/2018 Lilley
2019/0365029 A1 12/2019 Cross et al.
2019/0365044 A1 12/2019 Cross et al.
2019/0366667 A1 12/2019 Cross et al.

FOREIGN PATENT DOCUMENTS

TW I615104 B 2/2018
WO 2016144413 A1 9/2016

* cited by examiner

ARTICLE OF FOOTWEAR AND METHOD OF MANUFACTURING AN ARTICLE OF FOOTWEAR

CROSS-REFERENCE TO RELATED APPLICATION

This application claims the benefit of priority to United States Provisional Application No. 62/785,438, filed Dec. 27, 2018, which is hereby incorporated by reference in its entirety.

TECHNICAL FIELD

The present disclosure generally relates to an article of footwear and a method of manufacturing an article of footwear.

BACKGROUND

Footwear typically includes a sole structure configured to be located under a wearer's foot to space the foot away from the ground. Sole structures may typically be configured to provide one or more of cushioning, motion control, and resiliency.

BRIEF DESCRIPTION OF THE DRAWINGS

The drawings described herein are for illustrative purposes only, are schematic in nature, and are intended to be exemplary rather than to limit the scope of the disclosure.

DESCRIPTION

Figure 1:
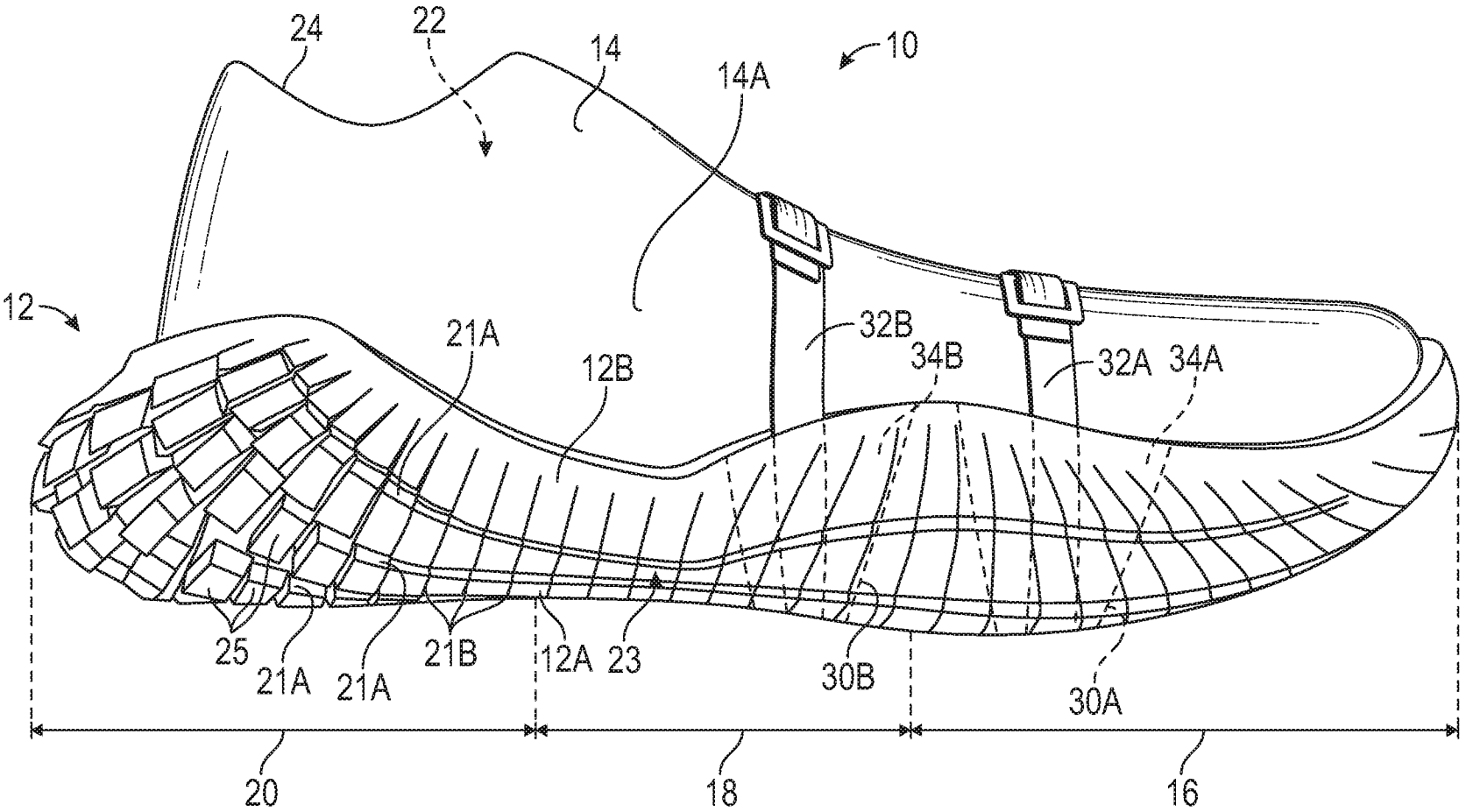
FIG. 1 is a lateral side view of an article of footwear including a sole structure and an upper.

The present disclosure generally relates to an article of footwear and a method of manufacturing an article of footwear with a sole structure adapted to conform to a foot disposed in an upper by tensioning a tensioning component disposed between the upper and the sole structure. By including a guide between the sole structure and the upper, the tensioning component is able to move relative to the sole structure and the upper along the guide to conform the sole structure around the upper and a foot disposed therein. The sole structure may have a relatively planar inner surface in its preform state (before it is formed to the upper), enabling a relatively easy process of rolling adhesive along the planar surface so that the sole structure may be adhered to the upper.

In conventional footwear construction, a sole structure may be molded into its final shape through a process such as compression molding or injection molding. Following this, the sole structure may be adhered to an upper, such as by applying an adhesive to both the final sole structure, and to a strobel portion of an upper and securing the components together. In the present disclosure, the sole structure has an intermediate shape (and may be referred to as an intermediate sole structure, or a preform sole structure), and is then thermoformed to the upper into a final shape. The sole structure has the intermediate molded shape prior to thermoforming. This process overcomes design constraints presented when molding is relied on to achieve a final shape of a sole structure, as designs with undercuts may be difficult to remove from a mold. Additionally, a sole structure that includes multiple layered materials is difficult or impossible to form by conventional molding, as molding a multi-material geometry may be difficult or impossible to control if the various materials are, for example, layered within protrusions or other isolated features.

In an example, an article of footwear may comprise a sole structure having an inner surface. A guide may be secured to the inner surface of the sole structure. An outer surface of the bottom of the upper may be secured to the inner surface of the sole structure around the guide with the guide between the bottom of the upper and the sole structure, the upper and the guide forming a passage. A tensioning component may extend along the guide in the passage, and may extend out of the passage at at least one of a medial side or a lateral side of the upper. The tensioning component may be movable in the passage relative to the upper and the guide in response to an increase in tension in the tensioning component to flexibly conform the sole structure to a foot disposed in the upper. Accordingly, in addition to the freedom of geometry and other benefits of a sole structure thermoformed to the upper, the guides and tensioning components enable the fit to be further adjusted to the wearer.

In one or more implementations, an outer surface of the guide may be adhered to a first portion of the inner surface of the sole structure, and the outer surface of the upper may be adhered to a second portion of the inner surface of the sole structure and not adhered to an inner surface of the guide at the passage.

In one or more configurations, the sole structure may have a base portion, a medial side wall portion at a medial side of the base portion extending upward from the base portion along the medial side of the upper, and a lateral side wall portion at a lateral side of the base portion extending upward from the base portion along the lateral side of the upper. The guide may extend along the inner surface of the sole structure at the base portion and at at least one of the medial side wall portion or the lateral side wall portion.

In an aspect of the disclosure, the upper may be configured as a strobel-less bootie or sock. In a further aspect, an adhesive layer may be disposed on the inner surface of the sole structure and may secure the guide and the upper to the inner surface of the sole structure.

The sole structure may be siped in order to further enhance its ability to be adjusted to fit the foot disposed in the upper. For example, in one or more configurations the sole structure may have a plurality of sipes extending partway through the sole structure at an outer surface of the sole structure, and the sipes may be adapted to splay further open when the tensioning component is tensioned. In a further aspect, the sole structure may include a plurality of sipes extending partway through the sole structure at the inner surface of the sole structure. The sipes at the inner surface of the sole structure may be offset from and may alternate with the sipes at the outer surface of the sole structure. Furthermore, the sipes at the inner surface of the sole structure may be adapted to at least partially close when the tensioning component is tensioned. Stated differently, the sipes allow the sole structure to be more easily cinched around the foot disposed in the upper when the tensioning component is tightened.

In various configurations, one or more guides may be used, and the one or more tensioning components may have a fixed end fixed to the sole structure, or may simply extend in passages all the way across the sole structure without being fixed to the sole structure.

For example, in one or more implementations, the guide may define an X-shape, and two intersecting passages may be formed between the guide and the bottom of the upper. A first tensioning component may be disposed in one of the two intersecting passages, and a second tensioning component may extend along the guide in another of the two intersecting passages and may cross over the first tensioning component.

In one or more configurations, the guide may be a first guide, the passage may be a first passage, and the tensioning component may be a first tensioning component that may have a fixed end fixed to the inner surface of the sole structure. The first tensioning component may extend along the first guide in the first passage from the fixed end and may extend out of the passage at the medial side of the upper. A second guide may be secured to the inner surface of the sole structure, and the upper and the second guide may form a second passage. A second tensioning component may have a fixed end fixed to the inner surface of the sole structure. The second tensioning component may extend along the second guide in the second passage from the fixed end, and may extend out of the passage at the lateral side of the upper. By placing the fixed end of the tensioning component nearer to the side opposite to the side at which it extends out of the passage and is pulled to increase tension, force on the sole structure at the fixed end is at a greater distance from the side at which the tensioning component is pulled, so that the tensioning component more easily cinches a greater portion of the sole structure.

In an aspect of the disclosure, tensioning components may be positioned to balance this cinching effect. For example, the fixed end of the first tensioning component may be fixed to the sole structure nearer to a lateral edge of the sole structure than a medial edge of the sole structure, and the fixed end of the second tensioning component may be fixed to the sole structure nearer to the medial edge than the lateral edge.

In another aspect, tensioning components may be arranged to provide a balanced and maximized cinching effect on the sole structure. A first guide and a second guide may be spaced apart from one another on the inner surface of the sole structure in a longitudinal direction of the sole structure. In one or more configurations, the first guide may be one of a plurality of medial guides and the second guide may be one of a plurality of lateral guides, each secured to the inner surface of the sole structure, and each forming a passage with the upper. The medial guides may be arranged in alternating order with the lateral guides. The first tensioning component may be one of a plurality of medial tensioning components each having a fixed end fixed to the sole structure nearer the lateral edge of the sole structure than the medial edge of the sole structure, and each extending in one of the passages along one of the medial guides from the fixed end, and extending out of the one of the passages at the medial side of the upper. The second tensioning component may be one of a plurality of lateral tensioning components each having a fixed end fixed to the sole structure nearer the medial edge of the sole structure than the lateral edge of the sole structure, and each extending in one of the passages along one of the lateral guides from the fixed end, and extending out of the one of the passages at the lateral side of the upper.

When multiple guides are used, they may be configured to also function as supports at the medial and lateral sides of the upper. For example, in one or more configurations, the medial guides may extend on the medial side of the upper to a medial side support and may be configured as a unitary, one-piece component with the medial side support. Similarly, the lateral guides may extend on the lateral side of the upper to a lateral side support and may be configured as a unitary, one-piece component with the lateral side support.

The disclosure also provides a method of manufacturing an article of footwear that has one or more guides and one or more tensioning components to conform the sole structure to a foot disposed in the upper as described. In an example, the method may comprise placing an upper on a last. The method may further comprise applying adhesive on an inner surface of a sole structure, and placing a guide on the adhesive. The method may also comprise placing a tensioning component on the guide, and then placing the inner surface of the sole structure against an outer surface of the upper to secure the sole structure to the upper with the adhesive, with a passage formed by the upper and the guide, and with the tensioning component in the passage.

In one or more implementations, the inner surface of the sole structure may be substantially planar when the adhesive is placed thereon, and the adhesive may be placed on the inner surface of the sole structure by rolling the adhesive on the inner surface of the sole structure. The planar configuration of the preform sole structure allows the relatively simple and fast rolling technique to be used to apply adhesive to the sole structure.

In an aspect of the disclosure, placing the guide on the adhesive on the inner surface of the sole structure may include aligning the guide with a locating feature on the inner surface of the sole structure.

In one or more configurations, the method may also comprise heating the sole structure before placing the inner surface of the sole structure against the outer surface of the upper, and forming the sole structure to the outer surface of the upper with the sole structure partially wrapping around and conforming to the upper at a medial side of the upper and at a lateral side of the upper, such that the inner surface of the sole structure is nonplanar.

In an aspect, the method may further comprise cutting sipes in the outer surface of the sole structure prior to forming the sole structure to the outer surface of the upper. The sipes are adapted to splay open when the sole structure is formed to the upper, and to splay further open in response to an increase in tension in the tensioning component. The method may further comprise cutting sipes in the inner surface of the sole structure prior to forming the sole structure to the outer surface of the upper. The sipes in the inner surface of the sole structure are adapted to partially close when the sole structure is formed to the upper, and to further close in response to an increase in tension in the tensioning component.

In one or more configurations, the tensioning component may be a first tensioning component, and the method may further comprise, placing a second tensioning component on the guide prior to placing the inner surface of the sole structure against the outer surface of the upper, with the second tensioning component crossing over the first tensioning component.

In one or more implementations, placing a tensioning component on a guide may include positioning the tensioning component so that an end of the tensioning component extends off of the guide and onto the inner surface of the sole structure, the end fixed to the sole structure by the adhesive, and the tensioning component extends along the guide from the end, and out of the passage at a medial side or a lateral side of the upper.

In an aspect of the disclosure, the guide may be a first guide, the passage may be a first passage, the tensioning component may be a first tensioning component that extends out of the first passage at the medial side of the upper, and the method may further comprise, prior to placing the inner surface of the sole structure against the outer surface of the upper, placing a second guide on the adhesive. The method may further comprise placing a second tensioning component on the second guide, the upper and the second guide forming a second passage and the second tensioning component extending off of the second guide to an end on the inner surface of the sole structure. This end of the second tensioning component is fixed to the sole structure by the adhesive, and the second tensioning component extends along the second guide from the fixed end and out of the second passage at the lateral side of the upper.

In one or more configurations, the first guide may be one of a plurality of medial guides, each secured to the inner surface of the sole structure, and each extending along the inner surface and forming a passage with the upper. The second guide may be one of a plurality of lateral guides, each secured to the inner surface of the sole structure, and each extending along the inner surface of the sole structure and forming a passage with the upper. The method may further comprise placing the medial guides and the lateral guides on the inner surface of the sole structure so that the medial guides are arranged in alternating order with the lateral guides.

The above features and advantages and other features and advantages of the present teachings are readily apparent from the following detailed description of the modes for carrying out the present teachings when taken in connection with the accompanying drawings.

FIG. 1 shows an article of footwear 10 that includes a sole structure 12 secured to an upper 14. The article of footwear 10 includes a forefoot region 16, a midfoot region 18, and a heel region 20. The forefoot region 16 generally includes portions of the article of footwear 10 corresponding with the toes and the metatarsophalangeal joints (which may be referred to as MPT or MPJ joints) connecting the metatarsal bones of the foot and the proximal phalanges of the toes. The midfoot region 18 generally includes portions of the article of footwear 10 corresponding with the arch area and instep of the foot, and the heel region 20 corresponds with rear portions of the foot, including the calcaneus bone. The forefoot region 16, the midfoot region 18, and the heel region 20 are not intended to demarcate precise areas of the article of footwear 10, but are instead intended to represent general areas of the article of footwear 10 to aid in the following discussion.

The sole structure 12 may be siped in order to further enhance its ability to be adjusted to fit the foot disposed in the upper 14. Stated differently, sipes allow the sole structure 12 to be more easily cinched around the foot 40 disposed in the upper 14 when tensioning components are tightened, as further discussed herein.

For example, the sole structure 12 may have a plurality of sipes 21A, 21B extending partway through the sole structure at an outer surface 23 of the sole structure. The sipes 21A extend generally in a longitudinal direction of the sole structure 12, and the sipes 21B extend generally in a lateral direction of the sole structure 12. As used herein, a sipe, sipes, and siping is intended to refer to thin cuts in a surface of the sole structure 12. Sipes are typically formed via a secondary process after the sole structure 12 is initially molded to its preform state, but before it is formed (e.g., thermoformed) to the upper 14 as described herein. In some embodiments, the sipes 21A, 21B and sipes at the inner surface, if any, may be formed by cutting the preform sole structure 12 to a controlled depth, such as with a hot knife or laser. In general, the width of the cut is limited to the width of the tool used to make the cut. The plurality of sipes 21A, 21B may be cut, for example, using a blade, which may be heated to aid in creating a smooth cut with an acceptable surface finish on the sidewalls of the sipe. In another embodiment, one or more of the plurality of sipes 21A, 21B may be laser cut into the foam to a controlled depth. In some embodiments, each of the plurality of sipes may be cut to varying depths, dependent on the sole thickness, cushioning design objectives, and desired final sole appearance. In some embodiments, the stiffness and/or cushioning properties of any one or more protuberances defined by the sipes (or of the sole in that local area) may be altered to meet different design objectives by varying the depth of the adjacent sipes (i.e., where deeper sipes may provide a less stiff sole structure with increased cushioning). In some embodiments, the sipes 21A, 21B may all be cut in an orthogonal direction relative to the inner surface of the sole structure 12 when the inner surface has the substantially planar configuration.

In one embodiment, the sipes may be cut such that they all extend into the outer surface 23 of the sole structure 12 from a common direction. Such a design may increase manufacturing efficiency by eliminating any need to reorient a cutting tool for each sipe or each portion of a sipe. In an embodiment where the inner surface is substantially flat/planar when the sole structure 12 is in the preform state, this common cutting direction may be orthogonal to the inner surface. In another embodiment, one or more of the sipes 21A, 21B maybe at an oblique angle relative to the inner surface 15. Making such an oblique cut may enable unique geometries to be created when the sole structure is subsequently thermoformed to the upper.

The sole structure 12 defines a plurality of protuberances 25 that are separated from each other via the plurality of sipes 21A, 21B. Only some of the protuberances 25 are labelled in FIG. 1. As further shown in FIG. 1, when the sole structure 12 is thermoformed to the upper 14, some or all of the plurality of sipes 21A, 21B may splay partially open as a result of the bending that occurs in the sole structure 12. As will be discussed below, in an embodiment where a flat inner surface of the sole structure is thermoformed to a substantially contoured/curved upper 14 on a last, a substantial majority of the sipes 21A, 21B may experience some amount of splaying during the thermoforming process so that, even in an untensioned state of the tensioning components discussed herein, the sipes 21A, 21B are splayed partially open. The sipes 21A, 21B then splay further open when the tensioning components are further tensioned. As such, the sipes 21A, 21B aid in increasing the flexibility of the sole structure 12 and the ease with which it is made to conform to a foot disposed in the upper 14 when the tensioning components are tensioned.

Additionally, the sole structure 12 may include multiple layers, with an innermost layer at the inner surface, and an outermost layer at the outer surface 23. The sipes may extend only into the outermost layer, may terminate at a boundary between the outermost layer and the next inward layer, or may extend partially into the innermost layer as well. When the sipes 21A, 21B splay open, the existence of the various layers may be evident on the sides of the protuberances 25.

The upper 14 may be a variety of materials, such as leather, textiles, polymers, cotton, foam, composites, etc. For example, the upper 14 may be a polymeric material capable of providing elasticity, and may be of a braided construction, a knitted (e.g., warp-knitted) construction, or a woven construction. In some embodiment, the upper 14 may be secured at a lower extent to a strobel to create a foot-receiving cavity 22 that receives a foot inserted through an opening 24 in the upper 14, such as an ankle opening. In the embodiments shown, the upper 14 is instead a sock-like or bootie construction that includes a bottom portion so that the upper 14 is strobel-less, as shown herein. An insole (not shown) may rest in the foot-receiving cavity 22, or there may be no insole. The upper 14 may be tightenable around the foot by the use of the tensioning components described herein, and/or by laces, straps, or other tightening mechanisms.

Guides 30A, 30B (indicated only with hidden lines in FIG. 1) are secured at their respective outer surfaces to the inner surface of the sole structure 12, as further disclosed herein. The upper 14 has a bottom, and an outer surface of the bottom is secured to the inner surface of the sole structure 12 around the guides 30A, 30B with the guides 30A, 30B between the bottom of the upper 14 and the sole structure 12. For example, as further discussed herein, an adhesive layer may be disposed on the inner surface of the sole structure 12 and may secure the guides 30A, 30B and the upper 14 to the inner surface of the sole structure 12. The sole structure 12 has a base portion 12A, a lateral side wall portion 12B at a lateral side of the base portion 12A that extends upward from the base portion 12A along the lateral side 14A of the upper 14, and a medial side wall portion (not visible in FIG. 1) extending upward from the base portion on the medial side of the upper. The guides 30A, 30B extend along the base portion 12A of the sole structure 12 and along the lateral side wall portion 12B of the sole structure 12 at the inner surface of the sole structure 12.

The outer surface of the bottom of the upper 14 forms a passage 34A with the guide 30A, and another passage 34B with the guide 30B. The passages 34A, 34B are indicated as hidden in FIG. 1, as they are between the outer surface of the upper 14 and the inner surface of the guides 30A, 30B because these surfaces are not adhered to one another. Tensioning components 32A, 32B are adhered at fixed ends to the inner surface of the sole structure 12, and extend lengthwise along the guides 30A, 30B in the passages 34A, 34B, and out of the passages 34A, 34B at the lateral side 14A of the upper 14.

Figure 2:
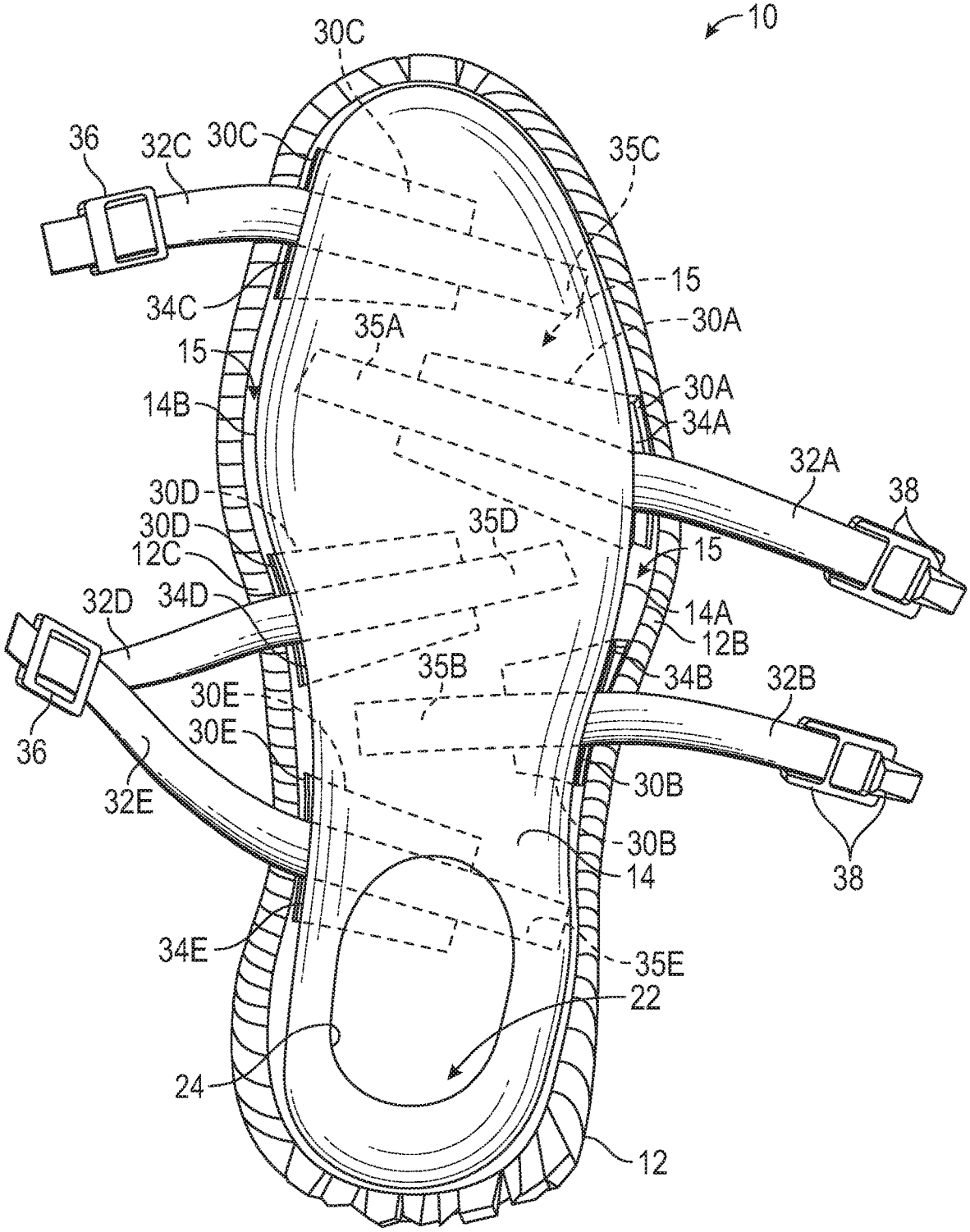
FIG. 2 is a top view of the article of footwear of FIG. 1, with tensioning components shown in an untensioned state.

FIG. 2 shows the article of footwear 10 in a top view. The passages 34A, 34B formed between the upper 14 and the sole structure 12 are visible at their ends at the lateral side 14A of the upper 14 where the tensioning components 32A, 32B exit. The lateral side tensioning components 32A, 32B are shown in an untensioned state. The tensioning components 32A, 32B have fixed ends 35A, 35B adhered to the inner surface of the sole structure 12. Although the ends 35A, 35B are fixed, the tensioning components 32A, 32B are movable in the respective passages 34A, 34B relative to the upper 14 and the guides 30A, 30B in response to an increase in tension in the tensioning components 32A, 32B to flexibly conform the sole structure 12 to a foot disposed in the upper 14.

The article of footwear 10 also includes additional guides 30C, 30D, 30E secured at their respective outer surfaces to the inner surface 15 of the sole structure 12, as further disclosed herein. The guides 30A, 30B may be referred to as lateral guides, and the guides 30C, 30D, and 30E may be referred to as medial guides. The medial guides 30C, 30D, and 30E are arranged in alternating order with the lateral guides 30A, 30B in the longitudinal direction of the sole structure 12. In addition to the lateral sidewall portion 12B, the sole structure 12 also has a medial side wall portion 12C at a medial side of the base portion 12A that extends upward from the base portion 12A along the medial side 14B of the upper 14. The guides 30C, 30D, 30E extend along the base portion 12A of the sole structure 12 and along the medial side wall portion 12C of the sole structure 12 at the inner surface of the sole structure 12. The bottom of the upper 14 forms a passage 34C with the guide 30C, another passage 34D with the guide 30D, and another passage 34E with the guide 30E. The passages 34C, 34D, and 34E are between the outer surface of the upper 14 at the bottom of the upper and the inner surface of the guides 30C, 30D, 30E, respectively, because these surfaces are not adhered to one another.

Medial side tensioning components 32C, 32D, 32E are adhered at fixed ends 35C, 35D, 35E, respectively, to the inner surface 15 of the sole structure 12, and extend lengthwise along the guides 30C, 30D, 30E in the passages, and out of the passages at the medial side 14B of the upper 14.

The passages 34C, 34D, 34E are visible at their ends at the medial side 14B of the upper 14 where the tensioning components 32C, 32D, 32E exit. Although the ends 35C, 35D, 35E are fixed, the tensioning components 32C, 32D, 32E are movable in the respective passages 34C, 34D, 34E relative to the upper 14 and the guides 30C, 30D, 30E in response to an increase in tension in the tensioning components 32C, 32D, 32E to flexibly conform the sole structure 12 to a foot disposed in the upper 14.

An outer surface of the bottom of the upper 14 is secured to the inner surface 15 of the sole structure 12 around the guides 30C, 30D, 30E, with the guides 30C, 30D, 30E between the bottom of the upper 14 and the sole structure 12. For example, in FIG. 2, all areas of the inner surface 15 of the sole structure 12 and the bottom surface of the upper 14 that are disposed outside of the hidden lines denoting the guides 30A-30E are adhered to one another. However, the outer surface of the upper 14 is not adhered to the top or inner (i.e., proximal) surface of the guides 30A-30E, so that the upper may be lifted away from the by the tensioning components 32A-32E. The tensioning components 32A-32E are also not secured to the guides, allowing the tensioning components 32A, 32E to move slightly relative to the upper 14 and the sole structure 12 in the respective passages 34A-34E when pulled. However, because the bottom surface of the upper 14 is adhered to the inner surface 15 of the sole structure 12 everywhere else around the guides 30A-30E, this tightening of the tensioning components 32A-32E causes the sole structure 12 to tighten around the foot disposed in the upper 14, including by pulling the lateral and medial side wall portions 12B, 12C inward and/or upward, and cinching the base portion 12A of the sole structure 12.

For purposes of discussion, any of the guides 30C, 30D, 30E may be referred to as a first guide, any of the passages 34C, 34D, 34E may be referred to as a first passage, and any of the tensioning components 32C, 32D, 32E may be referred to as first tensioning components. Any of the guides 30A, 30B may be referred to as second guides, any of the passages 34A, 34B may be referred to as second passages, and any of the tensioning components 32A, 32B may be referred to as second tensioning components. The fixed ends 35C, 35D, 35E of the first tensioning components 32C, 32D, 32E are disposed nearer to a lateral edge (e.g., a lateral side edge) of the preform sole structure 12 than a medial edge (e.g., a medial side edge) of the preform sole structure 12. By contrast, the fixed ends 35A, 35B of the second tensioning components 32A, 32B are fixed to the sole structure 12 nearer to the medial edge than the lateral edge. By placing the fixed ends nearer to the side opposite to the side at which the tensioning component extends out of the passage and is pulled to increase tension, force on the sole structure 12 at the fixed end is at a greater distance from the side at which the tensioning component is pulled, and the tensioning component cinches a greater portion of the sole structure 12 between the fixed end and the pulled side. The medial guides 30C, 30D, and 30E are arranged in alternating order with the lateral guides 30A, 30B. By alternating the first tensioning components 32C, 32D, 32E with the second tensioning components 32A, 32B in a longitudinal direction of the sole structure 12, and likewise alternating the medial guides 30C, 30D, 30E with the lateral guides 30A, 30B, the overall cinching effect of the tensioning components on the sole structure 12 is maximized, and is also balanced about a longitudinal midline of the sole structure. For example, the lateral side portion and medial side portion are pulled inward and/or upward as a result of the tensioning without shifting a center of the base portion 12A significantly toward either sidewall portion 12B or 12C.

As can be seen in FIG. 2, the medial side tensioning components 32D and 32E in the midfoot region 18 and the heel region 20, respectively, are joined together through a female portion 36 of a buckle. A male portion 38 of the buckle is secured to the lateral side tensioning component 32B that extends from the midfoot region 18. The medial side tensioning component 32C in the forefoot region 16 is secured to a female portion 36 of another buckle. A male portion 38 of the buckle is secured to the lateral side tensioning component 32A that extends from the forefoot region 16. Although shown as buckles, other modes of tightening and/or fastening the tensioning components may be used, such as laces, snaps, hook-and-loop fasteners, etc.

Figure 3:
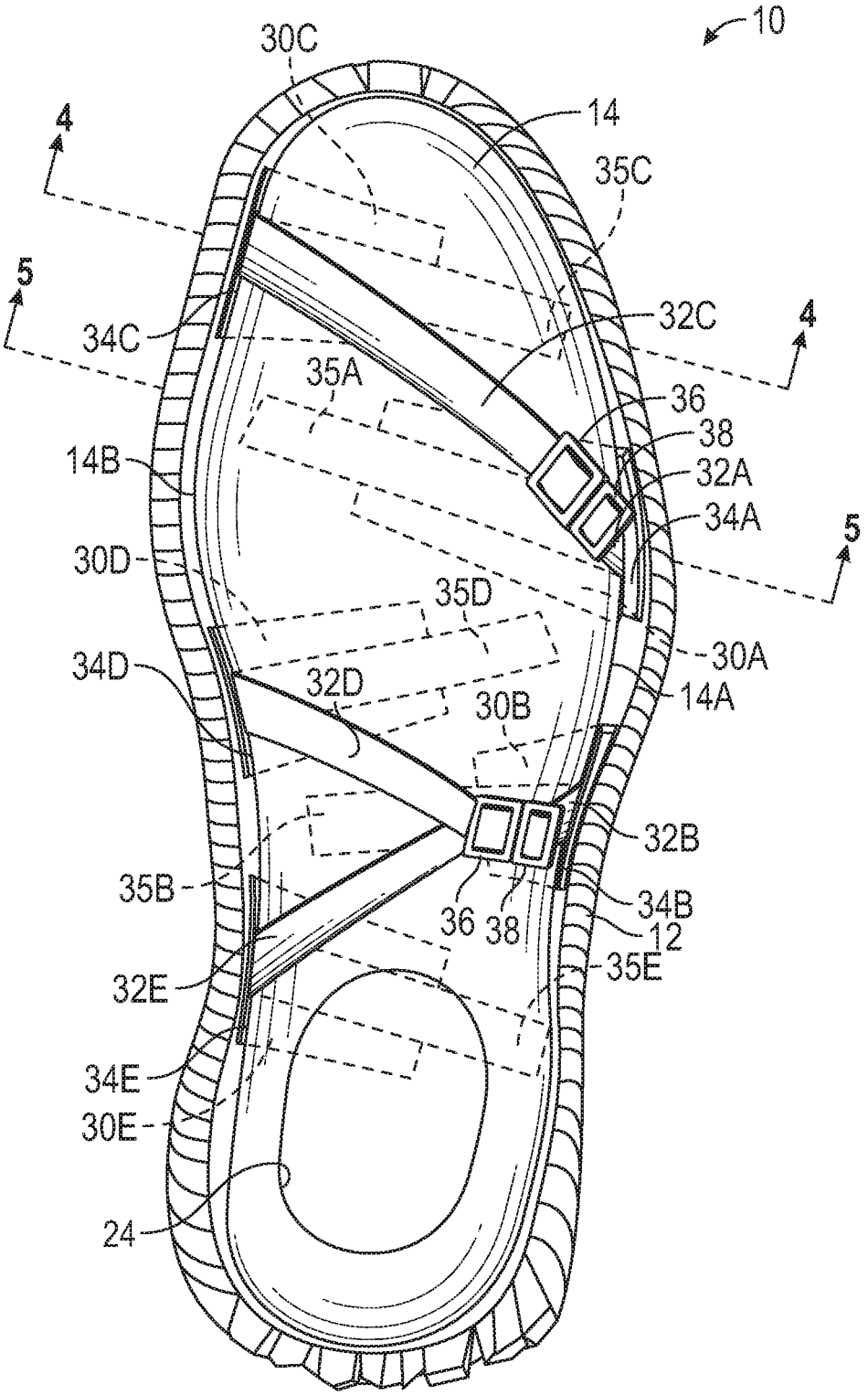
FIG. 3 is a top view of the article of footwear of FIG. 1, with tensioning components shown in a secured state.

Referring to FIG. 3, the tensioning components 32A-32E are shown secured to one another over the top of the outer surface of the upper 14. The female portion 36 of the buckle on the tensioning components 32D, 32E is buckled to the male portion 38 of the buckle that is secured to the lateral side tensioning component 32B. The female portion 36 of the buckle secured to the medial side tensioning component 32C is buckled to the male portion 38 of the buckle that is secured to the lateral side tensioning component 32A. In FIG. 3, the tensioning components are secured, but are only partially tensioned. A more customized fit of the sole structure 12 to the foot can be achieved by adjusting the position of the female and/or the male portions 36, 38 of the buckles on the tensioning components so that they create a tighter fit of the tensioning components around the upper 14 when buckled, and provide a greater cinching force on the sole structure 12. Unlike traditional straps, because the tensioning components 32A-32E have fixed ends 35A-35E secured to the sole structure 12 near the opposite side of the sole structure 12 from which they extend, and can move in the passages 34A-34E relative to the sole structure 12 and the upper 14, and because the sole structure 12 has lateral and medial side wall portions 12B, 12C extending from a base portion 12A as described herein, the sole structure 12 is easily cinched and wrapped partially around the foot.

Figure 4:
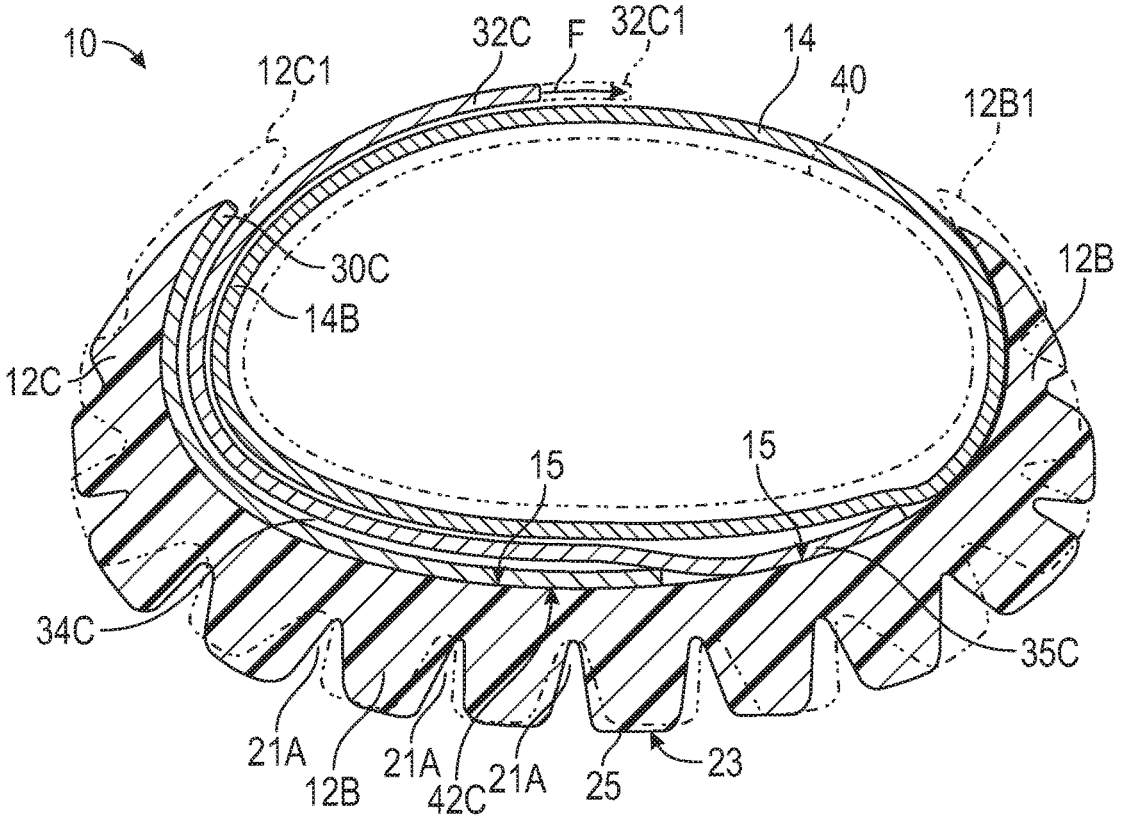
FIG. 4 is a cross-sectional view of the article of footwear of FIG. 3 taken at lines 4-4 in FIG. 3 with a state of increased tension in the tensioning components shown in phantom.

FIG. 4 illustrates how tensioning of the tensioning component 32C can achieve a more customized fit of the sole structure 12 to the foot 40 by causing the sole structure 12 to bend around and flexibly conform to the foot 40. For example, when a force F is applied to the free end of the tensioning component 32C, the tensioning component can move (e.g., slide) in the passage 34C relative to the upper 14 so that the free end moves to a new position 32C1. The fixed end 35C remains fixed in position. This may cause the medial side 14B of the upper 14 to move inward against the foot 40, although this is not shown for clarity in the drawing. Additionally, because of the adherence of the outer surface of the upper 14 to the inner surface of the sole structure 12 around the guide component 30C (e.g., forward of and rearward of the guide component 30C), the sole structure 12 moves (e.g., flexibly conforms) as is indicated by the phantom lines showing a new position 12C1 of the sidewall portion 12C and a new position 12B1 of the sidewall portion 12B moved higher and/or inward around the foot 40. The base portion 12A will also be tightened against the bottom of the foot 40. As is evident by the phantom lines in FIG. 4, the sipes 21A (only some of which are labeled) splay further open when the tensioning component 32C is further tensioned. The outer surface 42C of the guide 30C is shown adhered to the inner surface 15 of the sole structure 12. The fixed end 35C is also shown adhered to the inner surface 15.

Figure 5:
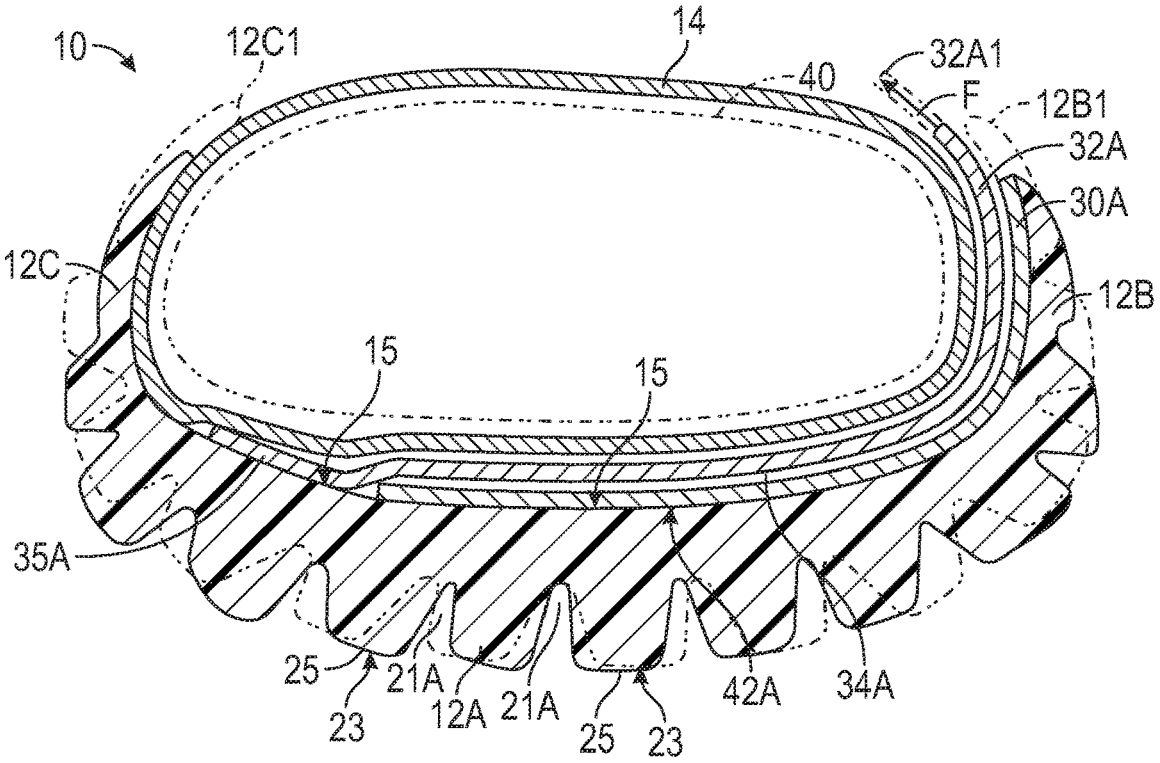
FIG. 5 is a cross-sectional view of the article of footwear of FIG. 3 taken at lines 5-5 in FIG. 3 with a state of increased tension in the tensioning components shown in phantom.

FIG. 5 illustrates how tensioning of the tensioning component 32A can achieve a more customized fit of the sole structure 12 to the foot 40 by causing the sole structure 12 to bend around and flexibly conform to the foot 40. For example, when a force F is applied to the free end of the tensioning component 32A, the tensioning component can move in the passage 34A relative to the upper 14 so that the free end moves to a new position 32A1. The fixed end 35A remains fixed in position. This may cause the lateral side of the upper 14 to move inward against the foot 40, although this is not shown for clarity in the drawing. Additionally, because of the adherence of the outer surface of the upper 14 to the inner surface of the sole structure 12 around the guide component 30A (e.g., forward of and rearward of the guide component 30A), the sole structure 12 moves (e.g., flexible conforms) as is indicated by the phantom lines showing the new position 12C1 of the sidewall portion 12C and the new position 12B1 of the sidewall portion 12B moved higher and/or inward around the foot 40. The base portion 12A will also be tightened against the bottom of the foot 40. As is evident by the phantom lines in FIG. 5, the sipes 21A (only some of which are labeled) splay further open when the tensioning component 32A is further tensioned. The outer surface 42A of the guide 30A is shown adhered to the inner surface 15 of the sole structure 12. The fixed end 35A is also shown adhered to the inner surface 15. Although FIGS. 4 and 5 show the effect of tensioning the tensioning components 32A and 32C, the sole structure 12 responds in a similar manner to increased tensioning of any or all of tensioning components 32B, 32D, and 32E.

Figure 6:
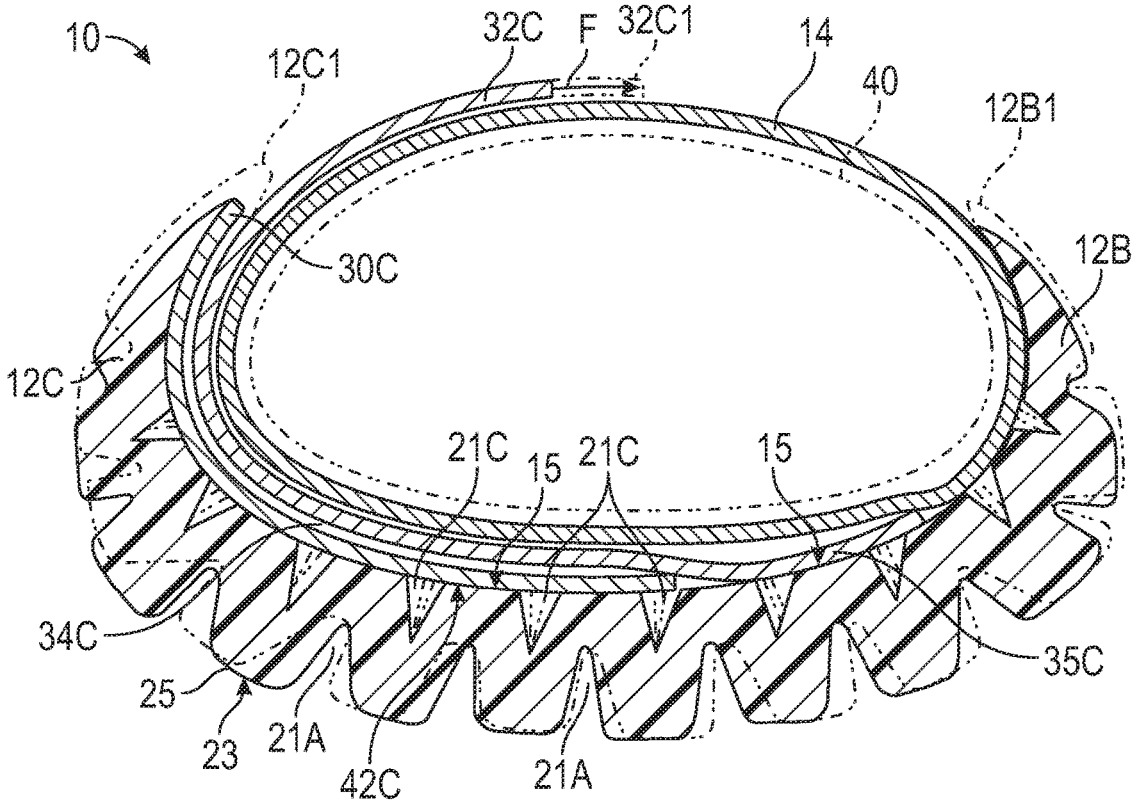
FIG. 6 is a cross-sectional view of an article of footwear with an alternative sole structure, and with a state of increased tension in the tensioning components shown in phantom.

FIG. 6 shows another aspect in which the sole structure 12 may include a plurality of sipes 21C extending partway through the sole structure at the inner surface 15 of the sole structure. FIG. 6 is intended to show a cross-section at the same location as FIG. 4 but with the sole structure 12 provided with sipes 21C. The sipes 21C extend generally in a longitudinal direction of the sole structure 12 and are adapted to at least partially close in response to increased tensioning in any or all of the tensioning components. The sipes 21C at the inner surface 15 of the sole structure 12 may be offset from and may alternate in a lateral direction of the sole structure 12 (e.g., a direction from the medial side wall portion 12C to the lateral side wall portion 12B of the sole structure 12) with the sipes 21A at the outer surface 23 of the sole structure 12, as indicated in FIG. 6. As illustrated by the phantom lines in FIG. 6, when a force F is applied to the free end of the tensioning component 32C, increasing the tension in the tensioning component 32C, the sipes 21C at the inner surface 15 of the sole structure 12 at least partially close. Stated differently, the sipes 21C allow the sole structure 12 to be more easily cinched around the foot 40 disposed in the upper 14 when the tensioning component 32C is tightened. Accordingly, when the sipes 21C at least partially close, the sipes 21A splay further open. The sipes 21C thus further allow the inner surface of the sole structure 12 to conform to the foot 40. Because the sipes 21A, 21C are offset from one another, this configuration further enables the sole structure 12 to flexibly conform to the shape of the foot 40.

Figure 7:
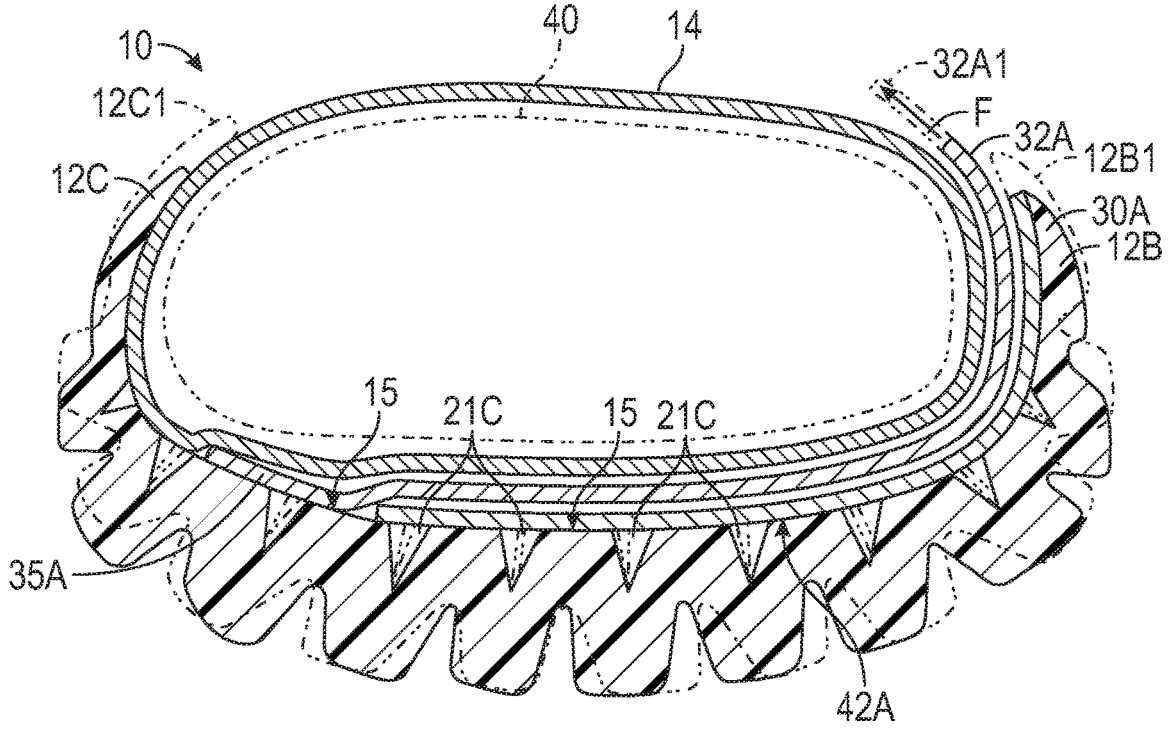
FIG. 7 is another cross-sectional view of the article of footwear of FIG. 6 with a state of increased tension in the tensioning components shown in phantom.

FIG. 7 is intended to show a cross-section at the same location as FIG. 5 but with the sole structure 12 provided with sipes 21C. As illustrated by the phantom lines in FIG. 7, when a force F is applied to the free end of the tensioning component 32A, increasing the tension in the tensioning component 32A, the sipes 21C at the inner surface 15 of the sole structure 12 at least partially close. Stated differently, the sipes 21C allow the sole structure 12 to be more easily cinched around the foot 40 disposed in the upper 14 when the tensioning component 32A is tightened. Accordingly, when the sipes 21C at least partially close, the sipes 21A splay further open.

Figure 8:
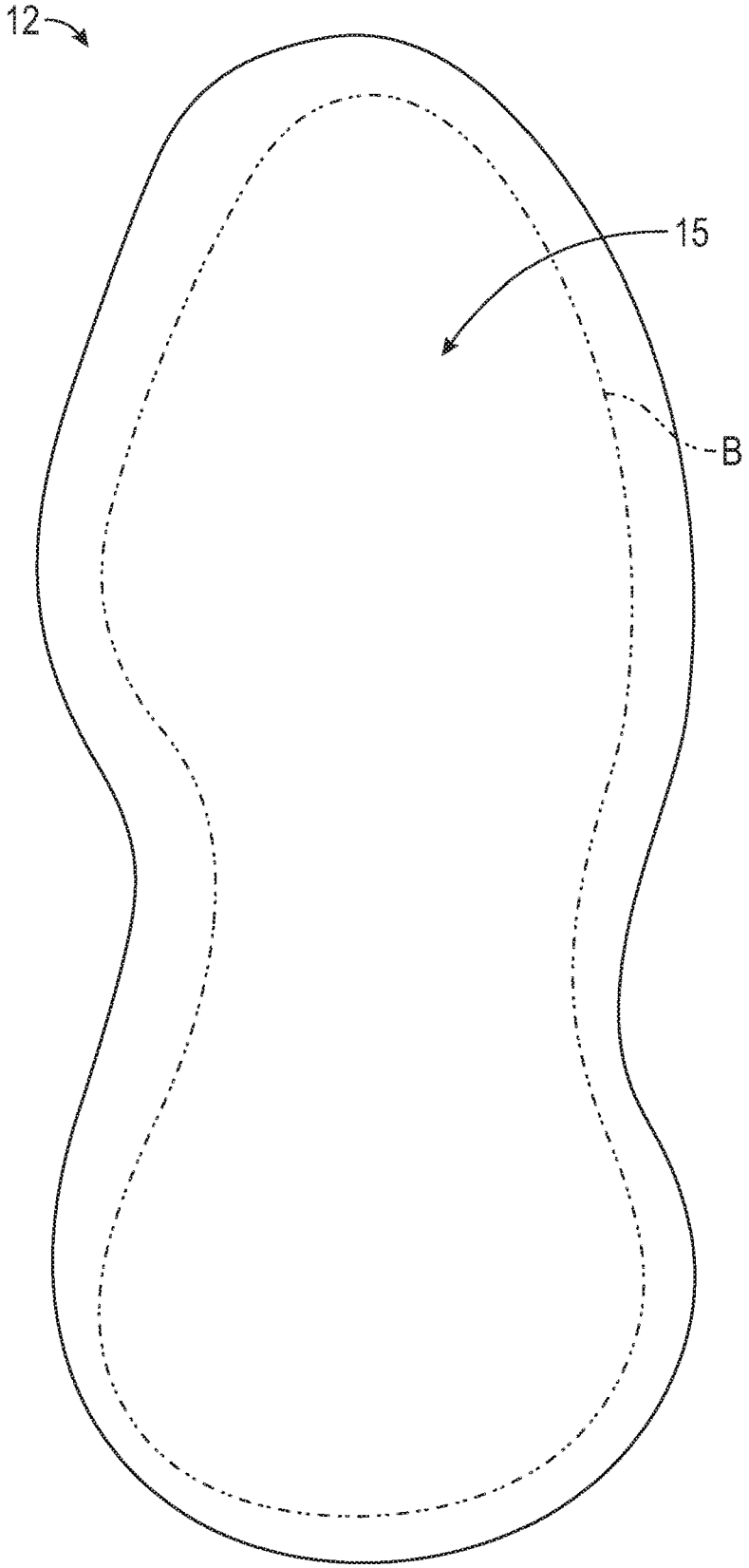
FIG. 8 is a top view of the sole structure of FIG. 1 prior to securement to the upper.

FIG. 8 shows the sole structure 12 after it is molded to its preform state, but prior to thermoforming to the upper 14. In this state, the sole structure 12 may be referred to as a preform sole structure 12, or an intermediate sole structure 12. The inner surface 15 of the sole structure 12 is shown. No sipes 21C are shown, but they could be cut into the inner surface 15. If the sole structure 12 is molded with multiple layers in the vertical direction, the portion of the sole structure exposed at the inner surface 15 is the innermost layer. The phantom line B represents an outer boundary of an outer layer of the sole structure 12 (disposed below the innermost layer in FIG. 8) if the sole structure 12 is molded with an inner layer and an outer layer.

Figure 9:
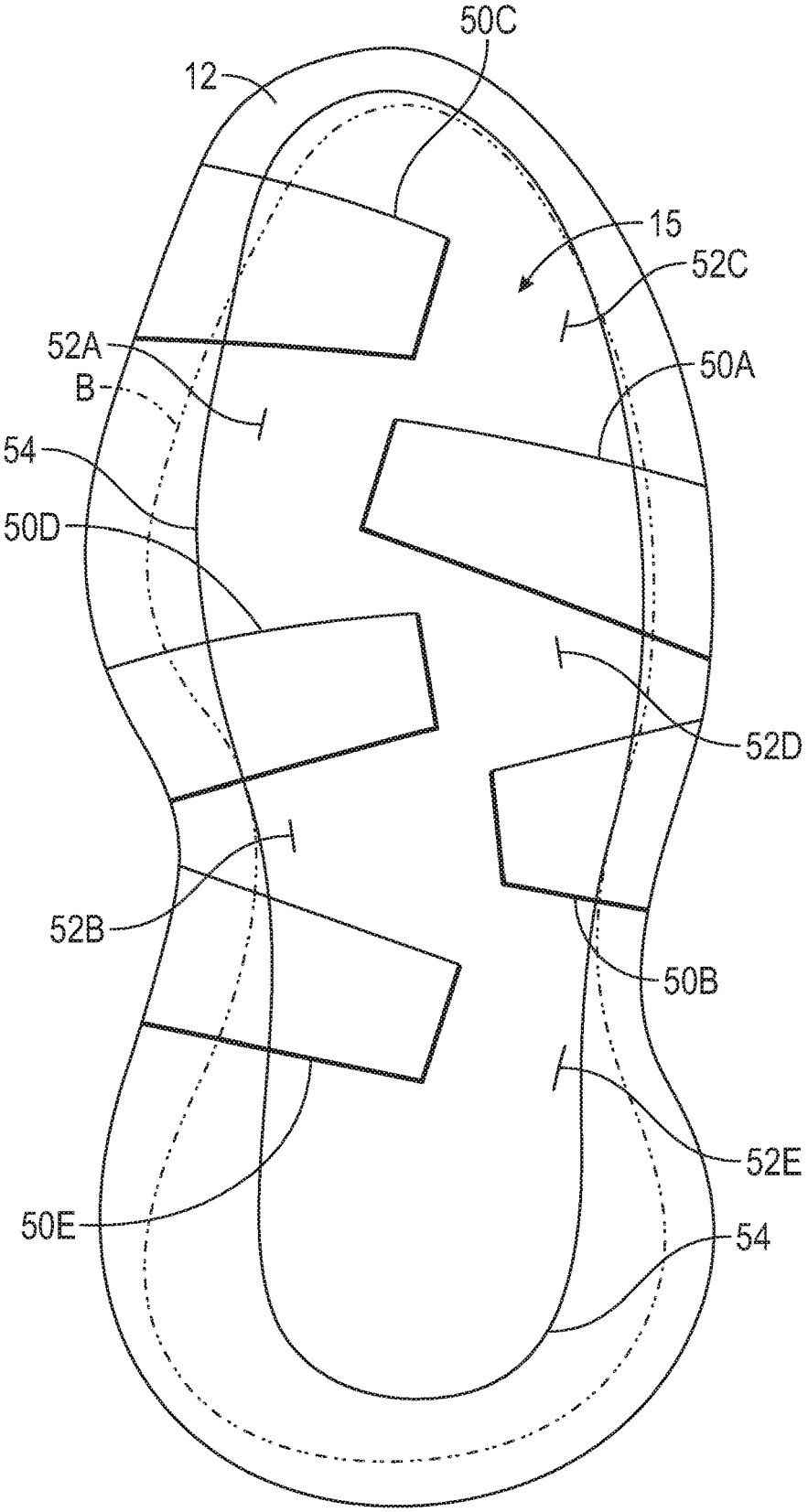
FIG. 9 is a top view of the sole structure of FIG. 8 with markings for placement of the upper, guides, and tensioning components.

FIG. 9 shows locating features that may be markings applied on the inner surface 15 of the sole structure 12 to serve as visual aids in placing the guides 30A-30E, the fixed ends 35A-35E of the tensioning components 32A-32E, and the upper 14 on the sole structure 12 so that they are adhered to the inner surface 15 at the correct relative locations. Locating features 50A, 50B, 50C, 50D, and 50E are markings having generally the same shapes as the guides, and are provided for locating the guides 30A, 30B, 30C, 30D, and 30E, respectively. Locating features 52A, 52B, 52C, 52D, and 52E are provided for locating the fixed ends 35A, 35B, 35C, 35D, and 35E, respectively. Locating feature 54 is provided for locating the bottom of the upper 14.

Figure 10:
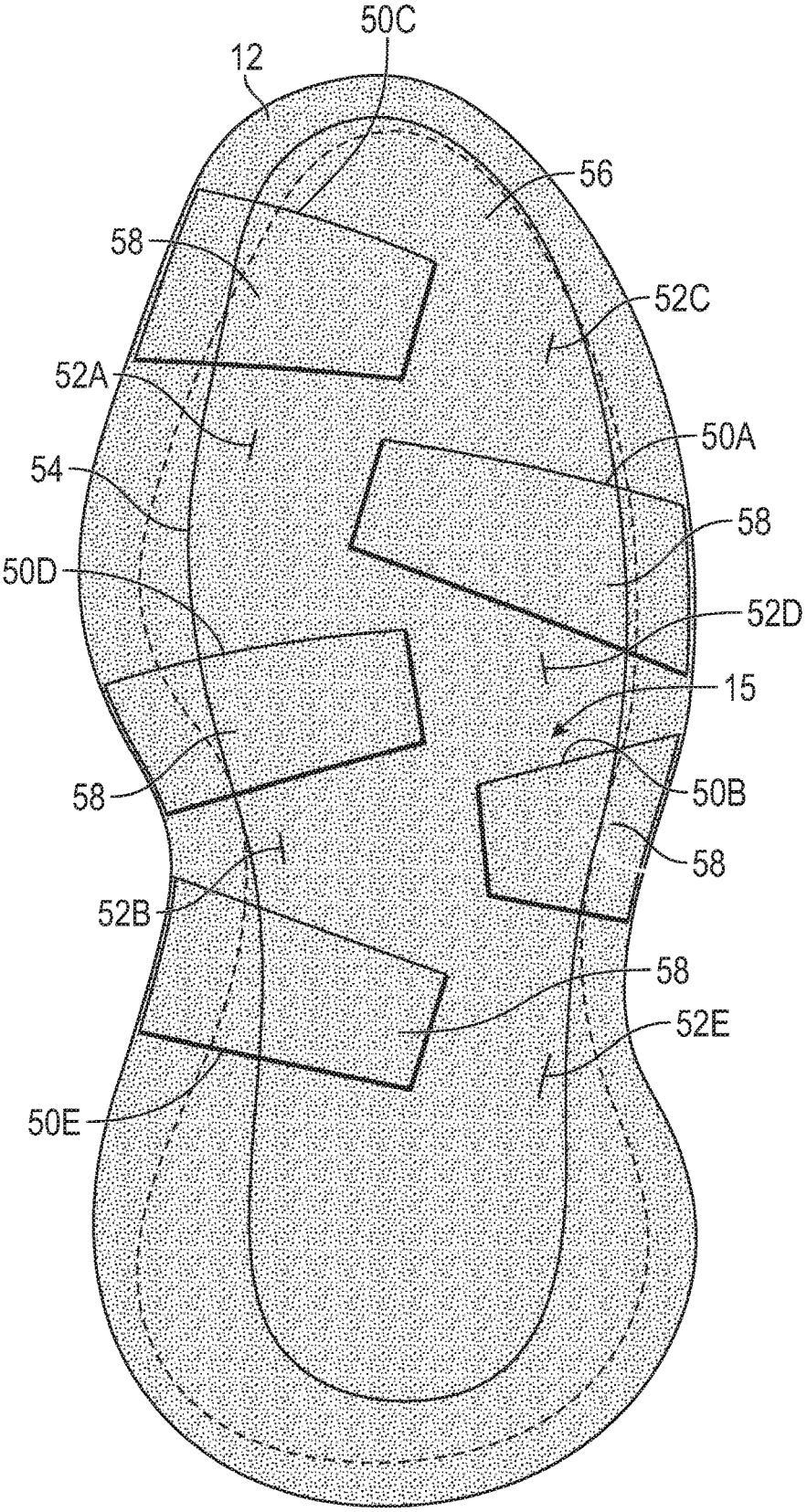
FIG. 10 is a top view of the sole structure of FIG. 8 with adhesive applied to a proximal, inner surface.

FIG. 10 shows an adhesive 56 placed on the entire inner surface 15 of the sole structure 12. The adhesive 56 may also be referred to as an adhesive layer. Because the inner surface 15 of the intermediate sole structure 12 is substantially planar, the adhesive layer 56 is relatively easy to apply via a roller as further discussed herein. The portions 58 of the inner surface 15 of the sole structure 12 surrounded by the markings for the locating features 50A, 50B, 50C, 50D, and 50E may be referred to as first portions of the inner surface 15 and are where the outer surfaces of the guides 30A-30E are adhered to the sole structure 12.

Figure 11:
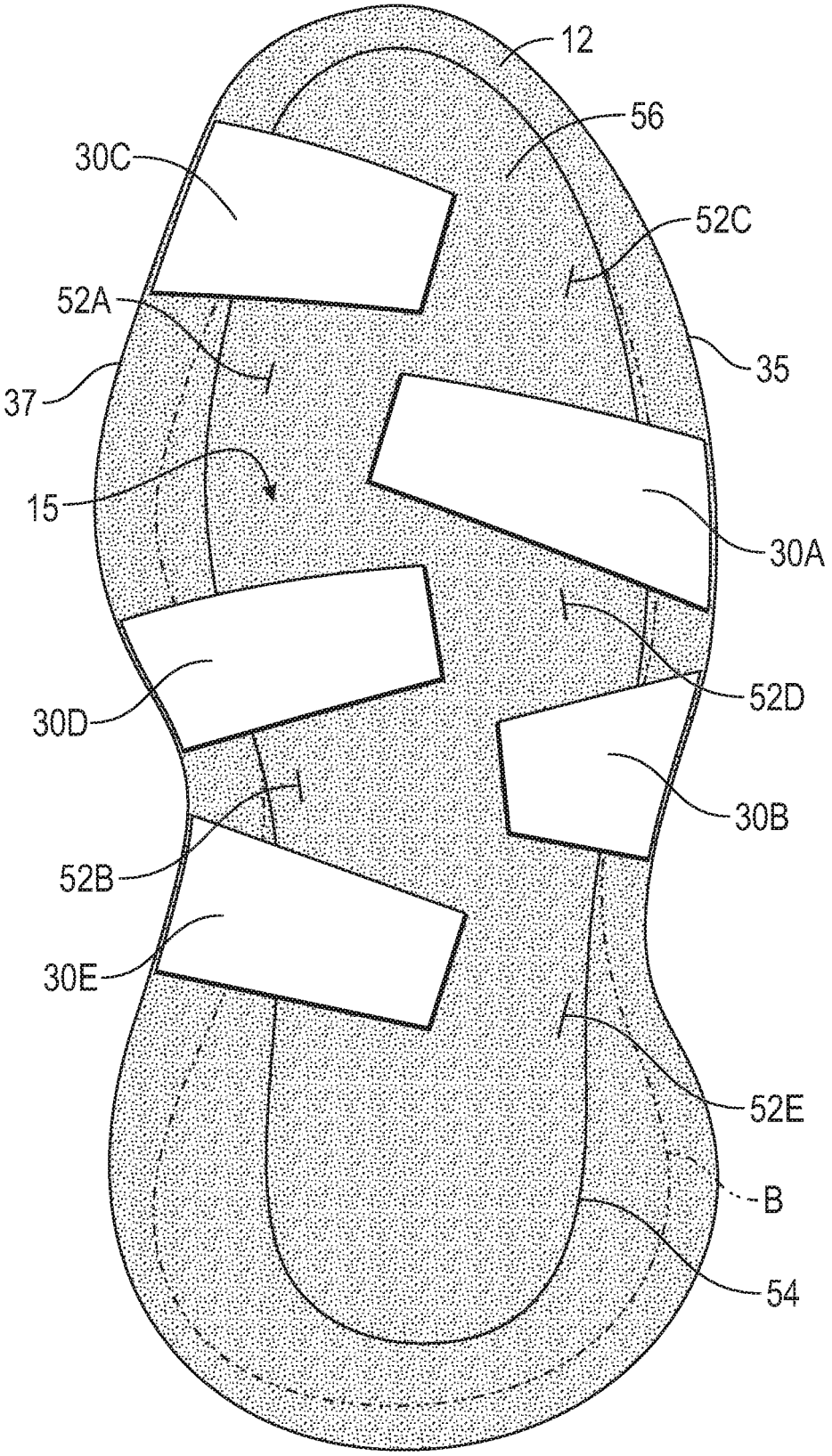
FIG. 11 is a top view of the sole structure of FIG. 10 with guides placed on the adhesive.

FIG. 11 shows the sole structure 12 with the guides 30A-30E placed at the respective locating features 50A-50E of FIG. 9 so that the outer surfaces of the guides 30A-30E are adhered to the inner surface 15 of the sole structure 12. Placing the guides 30A-30E on the inner surface 15 may include aligning the guides 30A-30E with the locating features 50A-50E, as indicated by a comparison of FIGS. 10 and 11. Aligning the guide 30A-30E and placing the guides 30A-30E on the inner surface 15 of the sole structure 12 may be done manually or may be automated and performed by a robotic machine. The medial guides 30C, 30D, and 30E are arranged in alternating order with the lateral guides 30A and 30B in the longitudinal direction of the sole structure 12.

Figure 12:
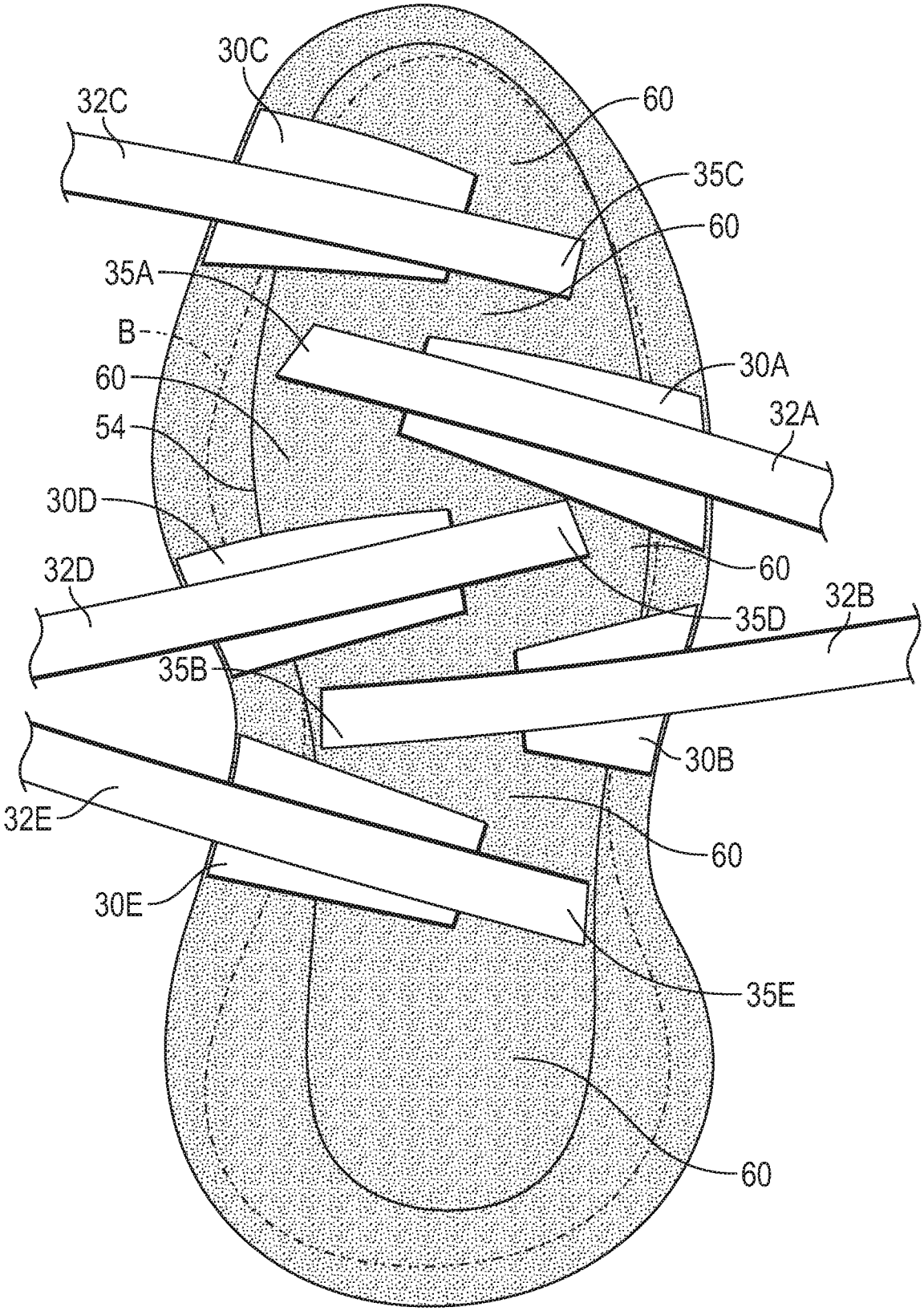
FIG. 12 is a top view of the sole structure of FIG. 11 with tensioning components placed on the guides and having ends extending onto the adhesive.

FIG. 12 shows a significant portion 60 of the inner surface 15 with adhesive 56 still exposed in FIG. 12 after the guides 30A-30E and the tensioning components 32A-32E are positioned on the inner surface 15. This portion may be referred to as a second portion of the inner surface 15 of the sole structure 12 and is the portion to which the outer surface of the upper 14 is adhered. Because there is no adhesive on the inner surfaces of the guides 30A-30E or on the inner surfaces of the tensioning components 32A-32E shown in FIG. 12, the bottom surface of the upper 14 will not be secured to these surfaces, and the passages 34A-34E will be formed between the upper 14 and the guides 30A-30E at the inner surfaces of the guides 30A-30E.

FIG. 12 shows that the tensioning components 32A-32E are positioned when they are placed on the respective guides 30A-30E so that an end 35A-35E of the tensioning component extends off of the guide and onto the inner surface 15 of the sole structure 12 and is fixed to the sole structure 12 by the adhesive 56.

Figure 13:
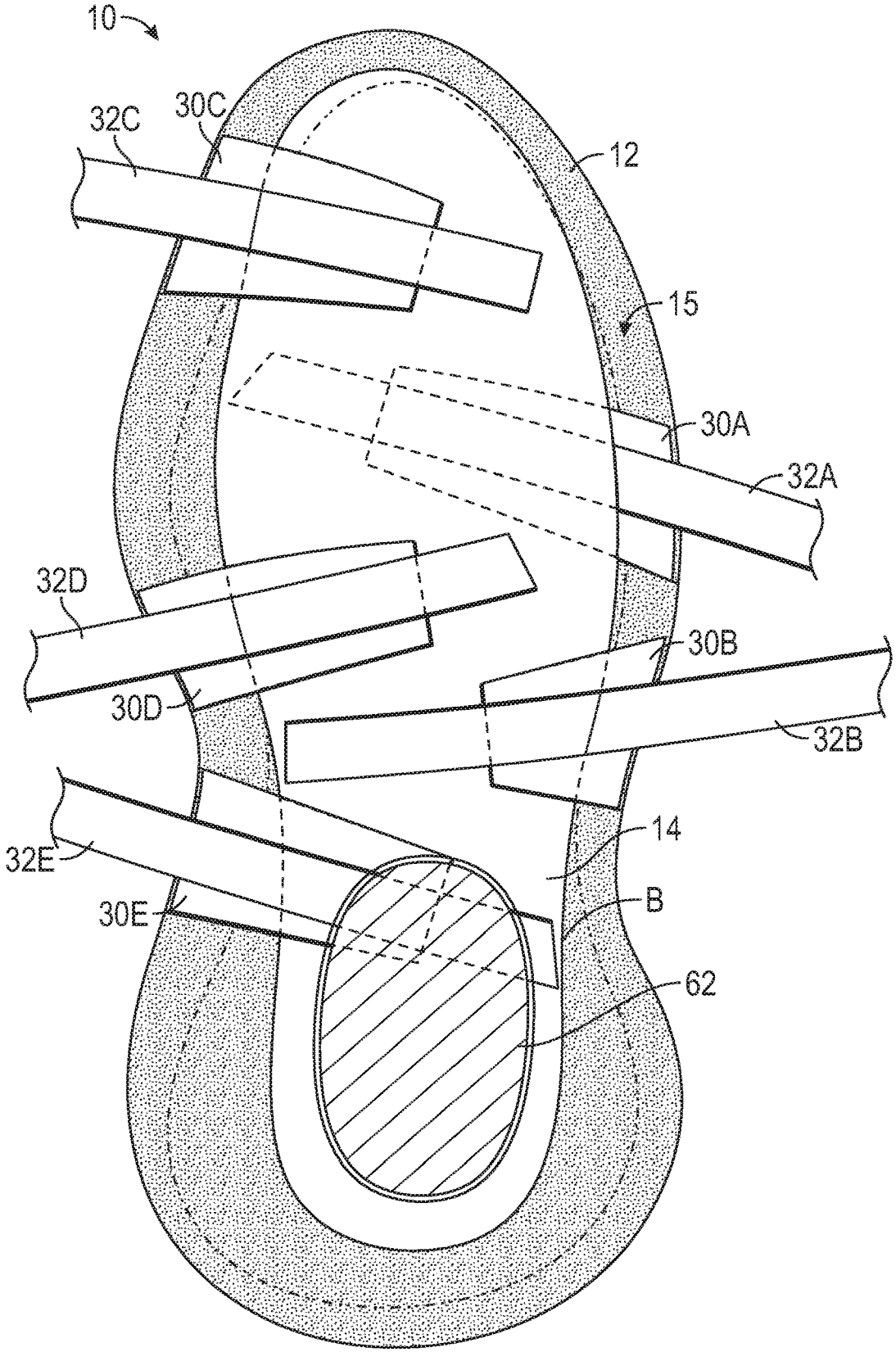
FIG. 13 is a top view of the sole structure of FIG. 12 with a lasted upper placed on the sole structure over the adhesive, the guides, and the tensioning components.

FIG. 13 shows that the upper 14 is placed on a last 62 so that it extends around the last 62 and has a three-dimensional foot shape of the last 62. The upper 14 may first be heated in some implementations, and the last 62 is then moved against the sole structure with the guides 30A-30E and tensioning components 32A-32E already placed on the sole structure, and the second portion 60 of the inner surface 15 of the sole structure 12 is placed against the outer surface of the upper 14 to secure the sole structure 12 to the upper 14 with the adhesive 56, with the passages 34A-34E formed between the upper 14 and the guides 30A-30E and the tensioning components 32A-32E in the passages 34A-34E.

Figure 14:
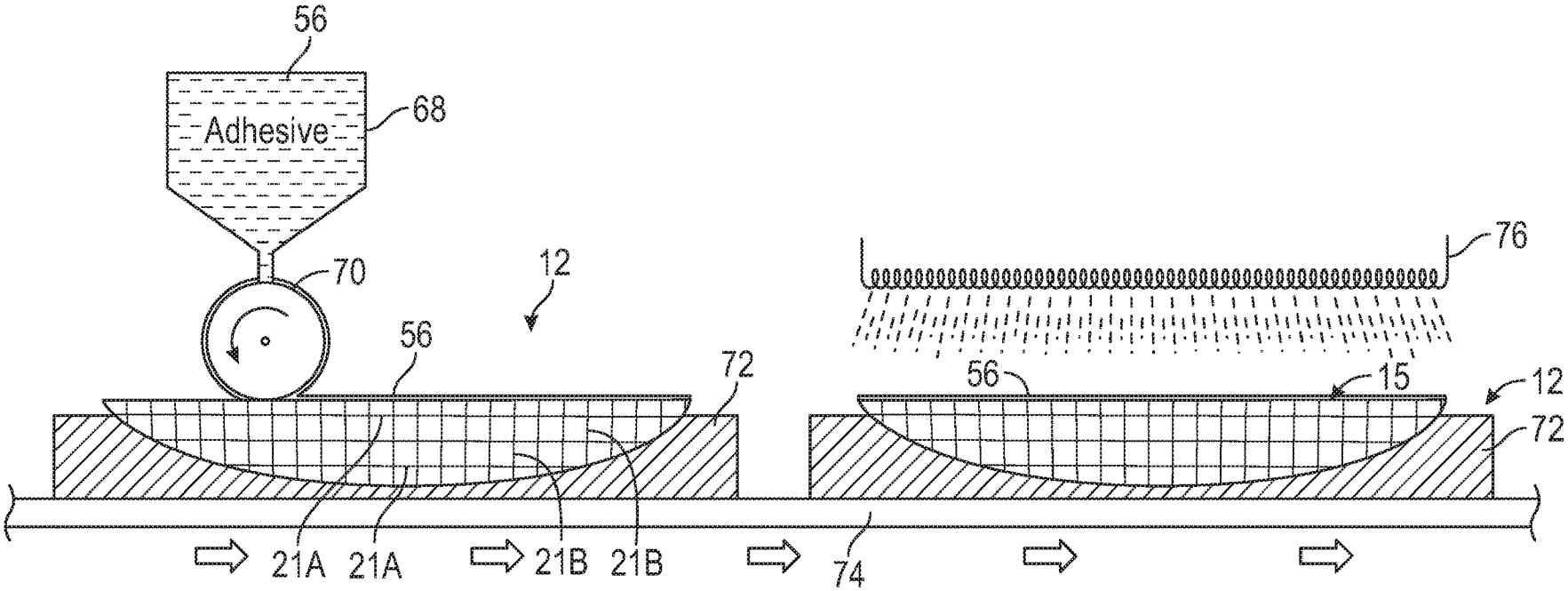
FIG. 14 is a partial cross-sectional view of an assembly diagram of a process for applying adhesive and heating a preform sole structure in a fixture shown in cross-section.

FIG. 14 shows that, once the preform sole structure 12 and a plurality of sipes 21A, 21B are cut into the outer surface 23 (and in some embodiments sipes are also cut into the inner surface), the adhesive 56 may be applied to the inner surface 15 of the sole structure 12. The adhesive 56 may be applied from a supply source 68, for example, using a brush, spray, or roller applicator. To minimize any required complexity, the roller applicator may be best suited for applications where the inner surface 15 is substantially planar, or, in other words, substantially flat. In such a configuration, the roller applicator may be a single roller 70 with a constant cylindrical cross-section, such as shown in FIG. 14, and the sole structure 12 may be cradled within a fixture 72 (shown in cross-section) that may serve as a heat sink and may be referred to as such. As an additional benefit of rolling, if any sipes are cut into the inner surface 15, such as shown in FIG. 6, then the roller applicator could most easily be controlled to avoid applying adhesive within the inner/upper sipes, and without the need to separately mask the sipes. In such an embodiment, the unadhered inner sipes 21C may permit each sipe to serve as an expansion gap that may permit purely in-plane stretch and/or flexure of the sole structure 12. When combined with a strobel-less upper 14, such a stretch or flexure response may be even further unrestrained (i.e., where relatively inelastic strobels are typically more restrictive than a strobel-less, all-knit upper would be).

Following the application of the adhesive 56, the sole structure 12 may continue on a conveyor 74 to be subjected to a thermoforming process to obtain its final shape and position on the upper 14. In general, the thermoforming process involves heating up at least a portion of the sole structure 12, forming it to a surface (e.g., via vacuum forming), and then cooling the sole structure to maintain it in the deformed state, although with flexibility to be resiliently deformed by selectively increasing tension in the tensioning components so that the sole structure 12 conforms to the foot as described herein. For example, the sole structure 12 may include a thermoplastic portion or layer near the inner surface 15 that easily deformed when heated. Accordingly, the sole structure 12 is first heated to soften the sole structure, and particularly at least any thermoplastic component or layer of the sole structure 12. As further shown in FIG. 14, in an embodiment, the heating may be performed by a radiant heating element 76 or convective heating nozzles (not shown) that apply thermal energy to only the inner surface 15 of the sole structure 12. As the outer surface 23 has already been siped through, the primary purpose of the heating is to soften the sole structure 12 at the inner surface 15 only to a point where it can be thermoformed to the upper 14. If the sole structure 12 is heated too much, then it may lose some structural integrity and/or its properties may change to an undesirable degree. As such, in an embodiment, a temperature gradient should exist between the inner surface 15 and the outer surface 23. In one configuration, the fixture 72 upon which the sole structure 12 rests may serve as a heatsink to cool the sole structure 12 at the outer surface 23 while the sole structure 12 is being heated at the inner surface 15. Doing so may ensure that the sole structure 12 does not deform at the outer surface 23 in any unintended ways while being thermoformed. The guides 30A-30E and the tensioning components 32A-32E may be placed on the adhesive 56 either before or after the sole structure 12 is heated at the inner surface 15.

Figure 15:
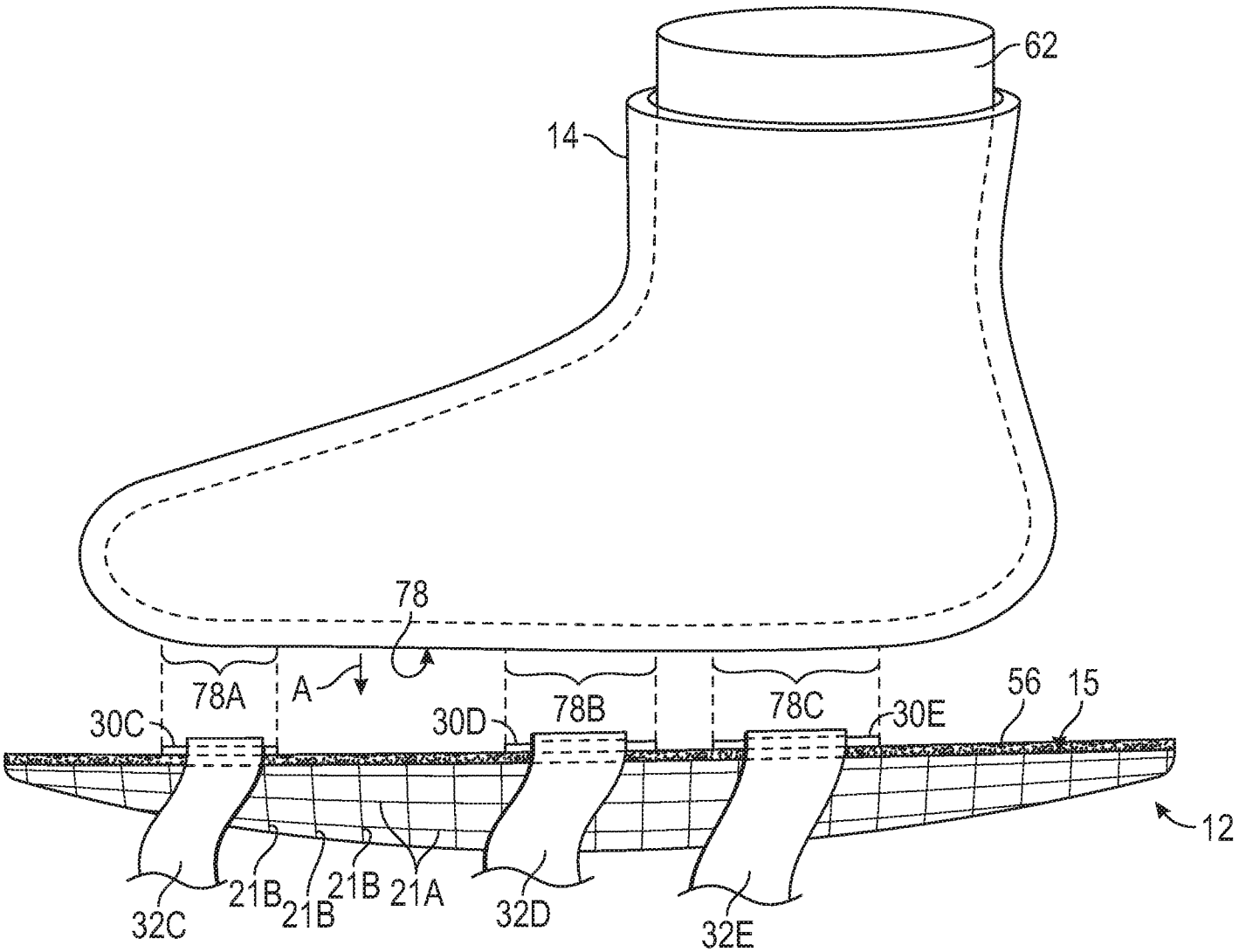
FIG. 15 is a medial side view of the lasted upper in the process of being placed on the sole structure over the adhesive, the guides, and the tensioning components.

Referring to FIG. 15, once the sole structure 12 is softened to a point where it may be thermoformed, it may then be positioned adjacent to the outer surface 78 of the upper 14 provided on the last 62. This is illustrated by directional arrow A in FIG. 15. However, sole structure 12 could instead or in addition be moved toward the upper 14. The portions of the outer surface 78 of the upper 14 that overlay the guides 30A-30E, such as portions 78A, 78B, 78C in FIG. 14, will not be adhered to the sole structure 12 (because there is no adhesive on the inner surface of the guides nor on the tensioning components on the guides, but portions of the outer surface 78 around the guides will directly contact the adhesive 56 and will thus be secured to the sole structure 12.

Figure 16:
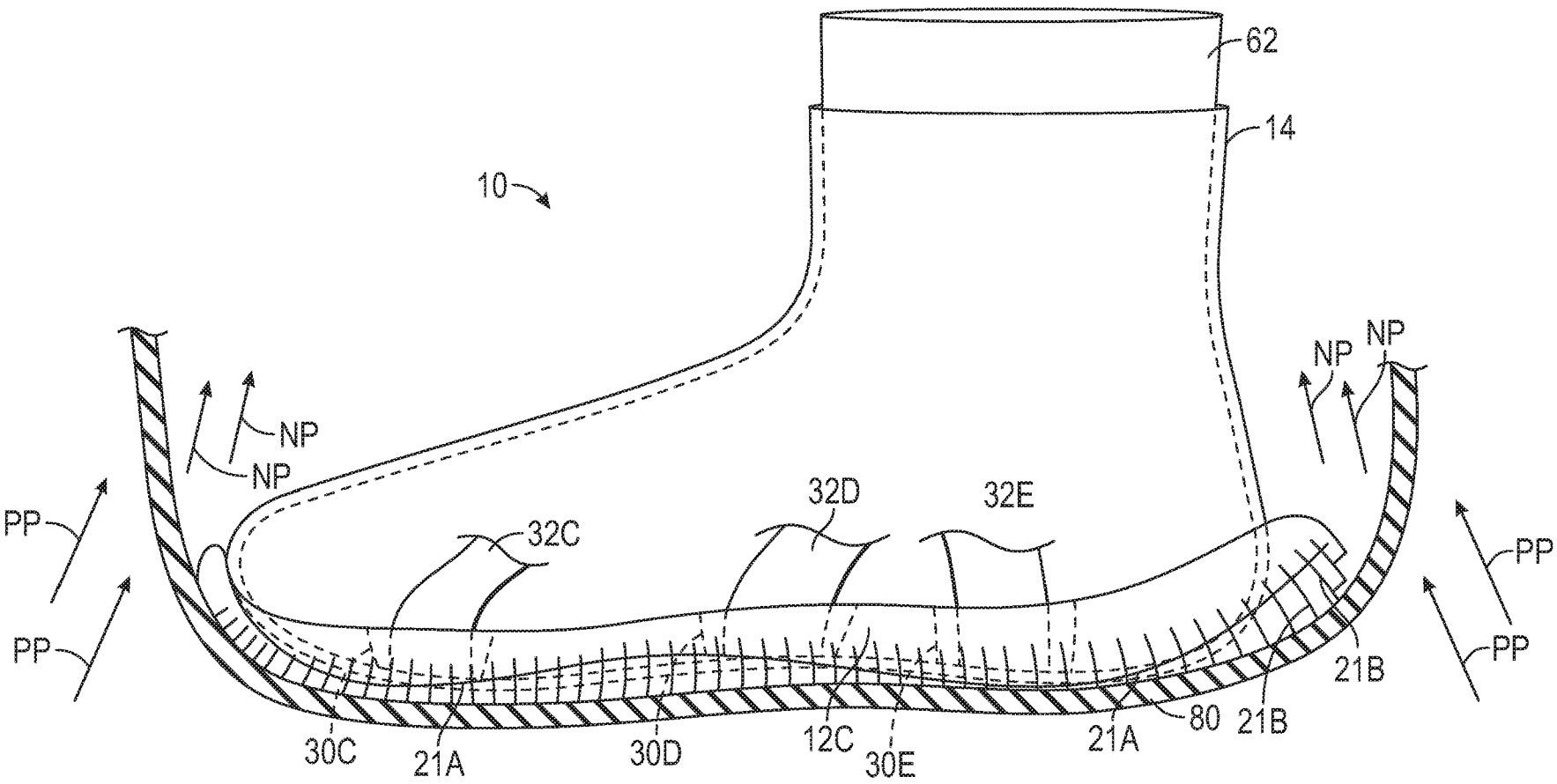
FIG. 16 is a medial side view of the lasted upper and sole structure of FIG. 15 with the sole structure being formed to the upper.

Referring to FIG. 16, once the outer surface 78 of the upper 14 is adjacent to the inner surface 15 of the sole structure 12, the sole structure 12 may be urged into contact with the upper 14, such as by vacuum forming, where it may then be cooled to retain its formed shape. For example, the softened sole structure 12 may be drawn into contact with the lasted upper 14, such as through the use of any or all of positive external pressure PP, negative internal pressure NP, compliant fixturing, or the like. In vacuum forming, the lasted upper 14 and sole structure 12 may be placed in their predefined arrangement under a compliant polymeric sheet 80 shown in cross-sectional view. Once in position, a vacuum may be created with the negative pressure NP such that the sheet 80 exerts a force against the sole structure 12 to urge it into contact with the upper 14. In doing so, the adhesive 56 may be drawn into contact with the outer surface 78 of the upper 14 and portions of the preform sole structure 12 may bend into contact with the medial and lateral sides of the upper 14, as well as around the rear of the upper in the heel region and the front of the upper in the forefoot region, such as shown at the medial side 14B in FIG. 16. Once thermoformed, the inner surface 15 is therefore no longer substantially planar, as shown in FIG. 4, for example. The bending caused by the vacuum forming then causes the plurality of sipes 21A, 21B to partially splay open to the positions shown in solid in FIG. 4, for example. When one or more of the tensioning components 32A-32E are then selectively tightened, the sipes 21A, 21B will splay further open, to the positions shown in phantom in FIG. 4, for example. If sipes 21C are provided at the inner surface 15, the bending caused by the vacuum forming then causes the plurality of sipes 21C to partially close to the positions shown in solid in FIG. 6, for example. When one or more of the tensioning components 32A-32E are then selectively tightened, the sipes 21C will further close, to the positions shown in phantom in FIG. 6, for example.

Figure 17:
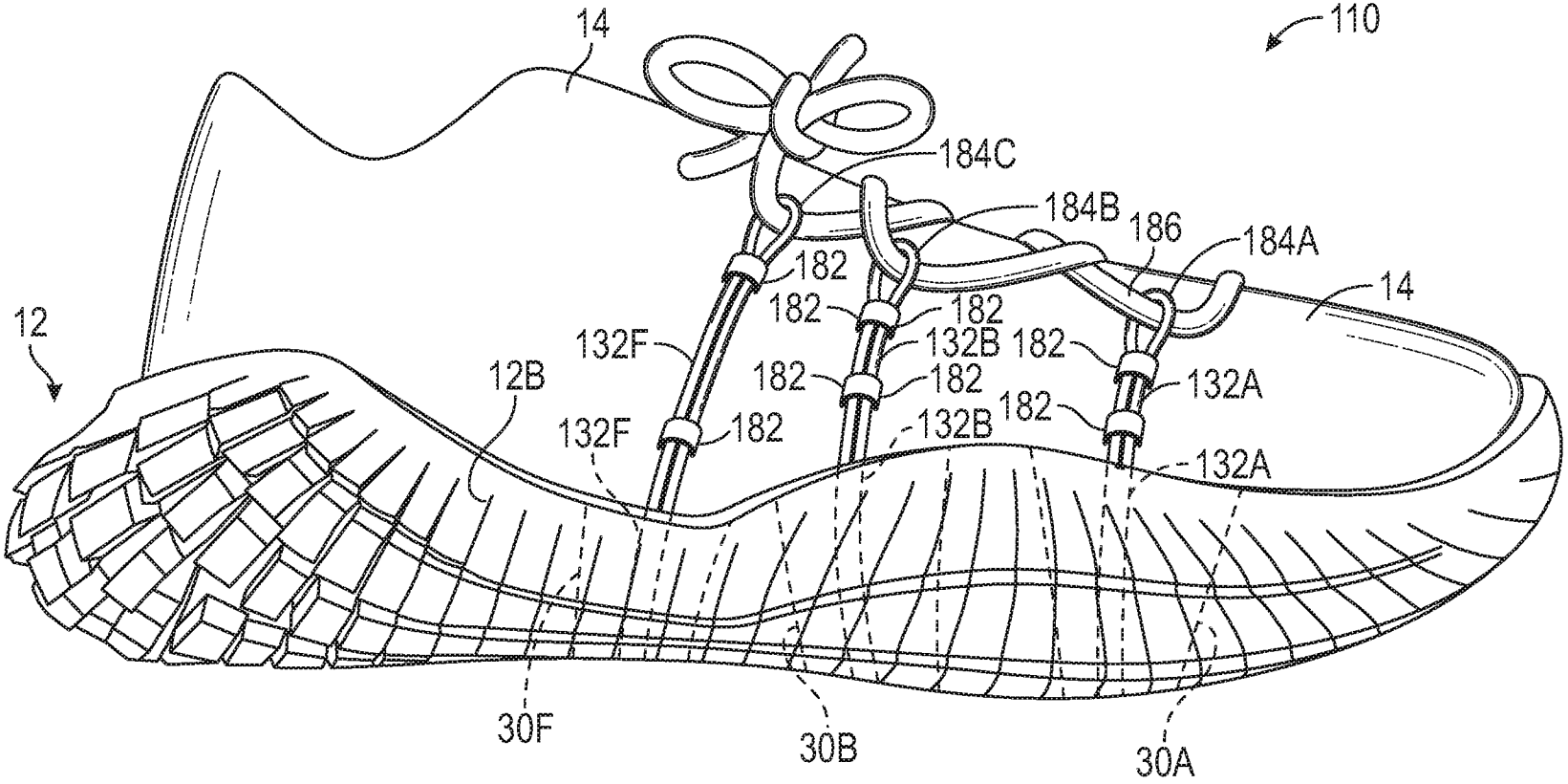
FIG. 17 is a lateral side view of an article of footwear.

FIG. 17 shows another embodiment of an article of footwear 110 that is alike in all aspects to the article of footwear 10 except that it includes an additional lateral guide 30F secured to the sole structure 12, and three lateral side tensioning components 132A, 132B, 132F having fixed ends secured to the inner surface of the sole structure 12, and extending upward through guide channels 182 on the side of the upper 14 to looped free ends 184A, 184B, 184C. A lace 186 extends through the looped free ends. The lace 186 also extends through like tensioning components extending on the medial side of the upper 14 out of passages formed by medial guide components between the upper and the sole structure. Tightening the lace 186 in turn pulls on the tensioning components to conform the sole structure 12 to a foot disposed in the upper 14.

Figure 18:
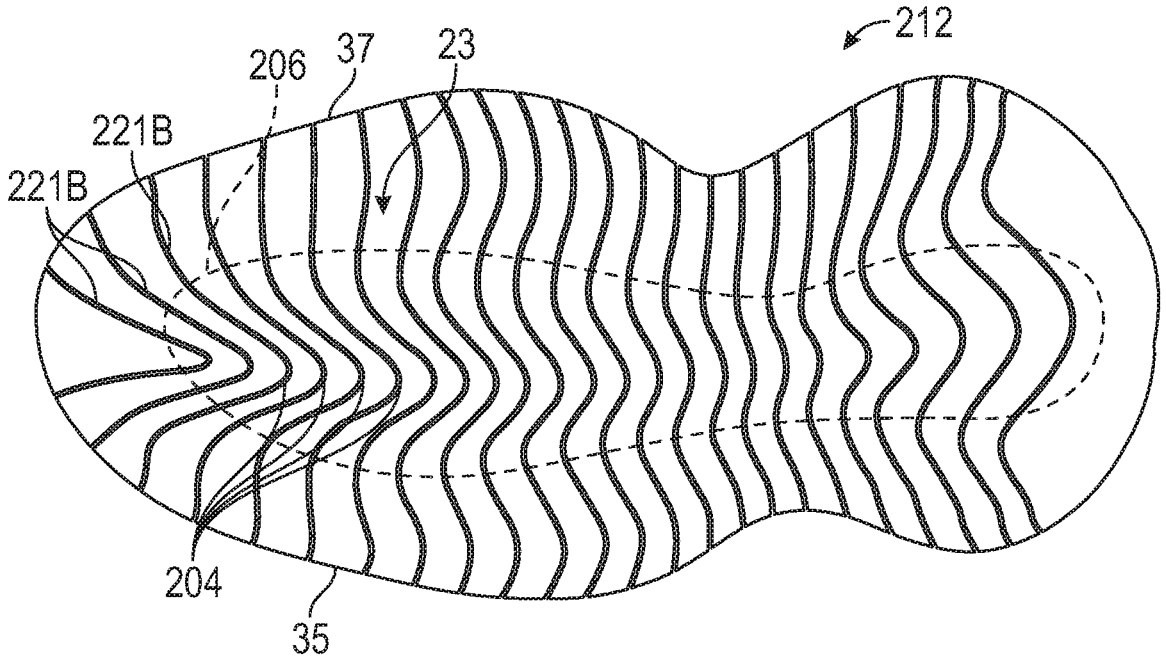
FIG. 18 is a bottom view of a sole structure.

FIG. 18 schematically illustrates a bottom view of another embodiment of a sole structure 212. This design generally includes a plurality of sipes 221B that each extend between the lateral edge 35 and the medial edge 37 of the sole structure 212. Each sipe 221B may incorporate a longitudinal deflection component 204 within a central region 206 of the sipe 221B that, to varying degrees, resembles a "U" or "V." Such a design may provide increased edge stability by not including any longitudinal siping (or sipes with a dominant longitudinal component) near the lateral edge 35 and the medial edge 37. Conversely, the longitudinal deflection component 204 within the central region 206 may permit foot roll and/or lateral foot expansion through a ground impact.

Figure 19:
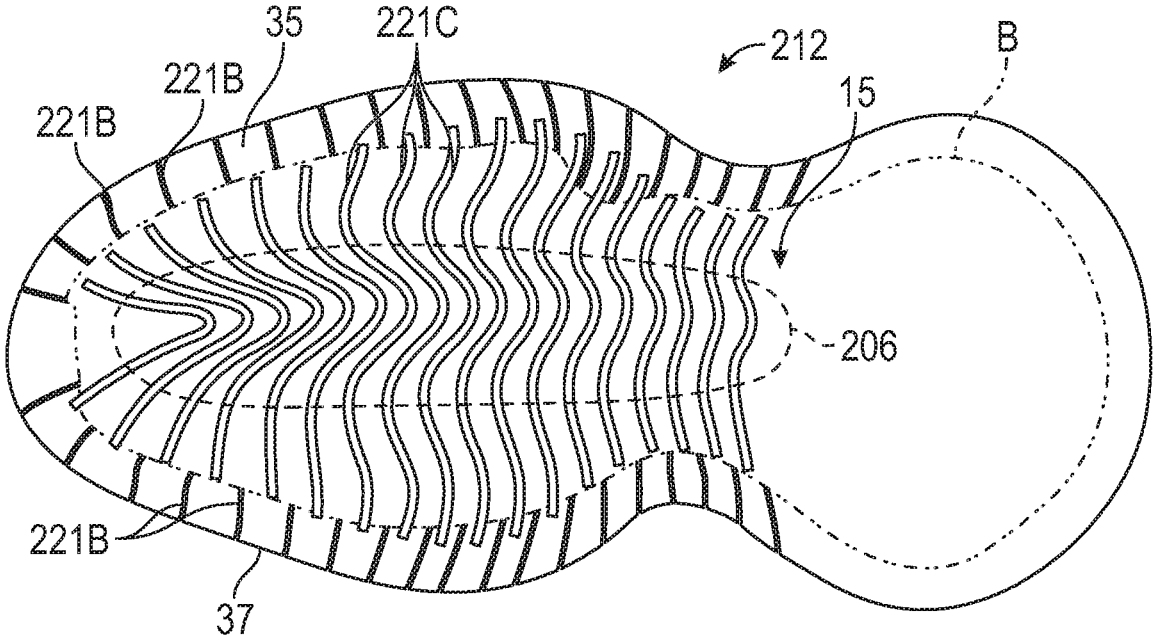
FIG. 19 is a top view of the sole structure of FIG. 18.

In some embodiments, the flexibility of the sole structure 212 may be further increased by incorporating or cutting one or more sipes 221C into the inner surface 15 of the sole structure 212, such as shown in FIG. 19. To ensure that the sole structure 212 remains waterproof and/or provides adequate protection against foreign objects on the ground, it is preferable for any sipes 221C cut into the inner surface 15 to not intersect with any sipes 221B cut into the outer surface 23. Doing so would result in a potential hole or opening extending entirely through the sole structure 212. As shown in FIGS. 18-19, in one configuration, the sipes 221C cut into the inner surface 15 may be staggered along a longitudinal axis relative to the sipes 221B cut into the outer surface 23.

While FIGS. 1 and 18 illustrate two potential siping patterns, other patterns and unique geometries are similarly possible. For example, in an embodiment, the sole structure 212 may include a plurality of sipes that all extend in a substantially longitudinal direction. In another embodiment, the sipes may extend diagonally from each of the medial and lateral edges. In a variation, these sipes may terminate prior to reaching the opposite edge.

Figure 20:
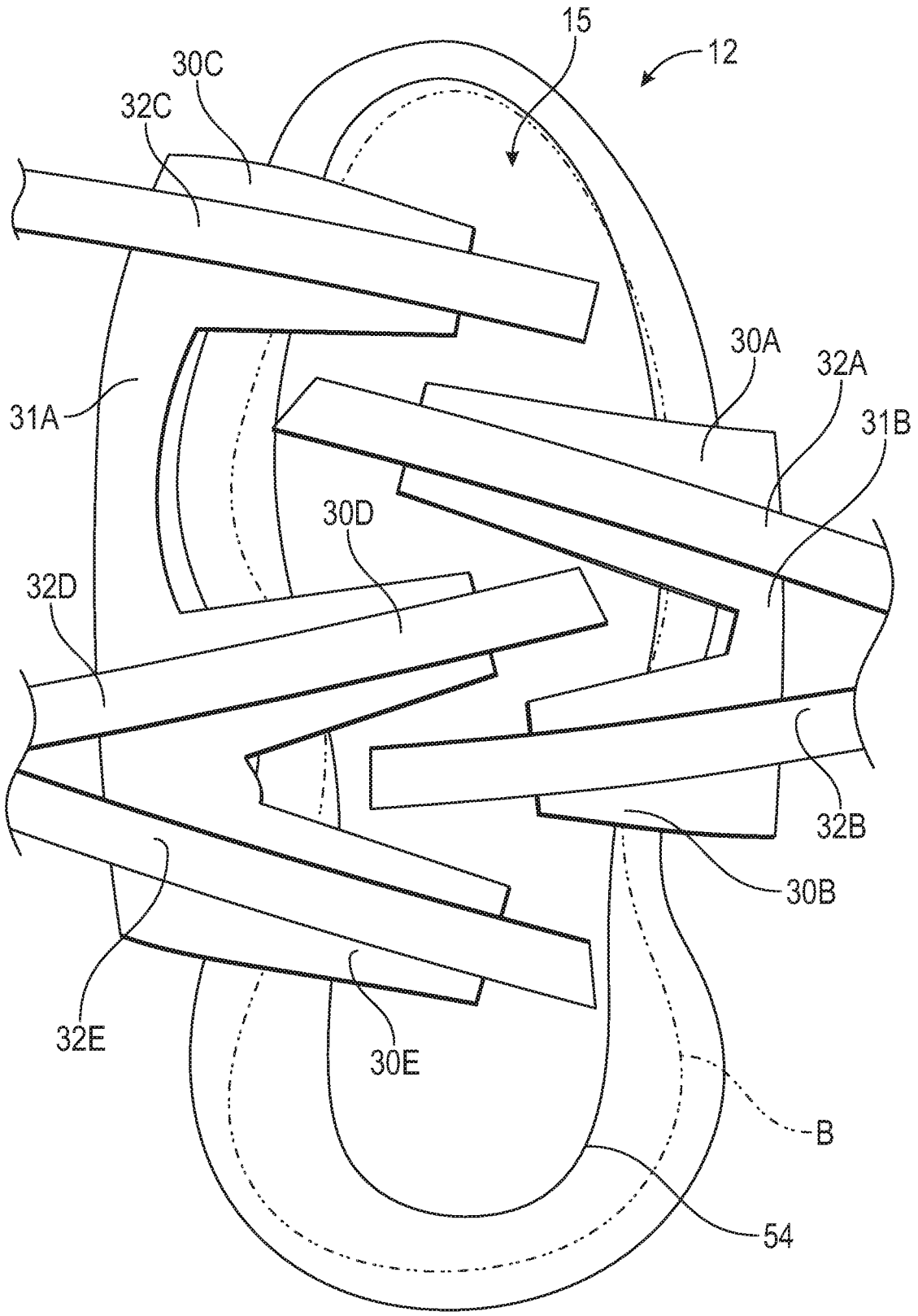
FIG. 20 is a top view of an assembly of a sole structure with guides and tensioning components.

FIG. 20 shows the sole structure 12 in its preform state with the plurality of medial guides 30C, 30D, 30E, each secured to the inner surface 15 of the sole structure 12, and with the plurality of lateral guides 30A, 30B, each secured to the inner surface 15 of the sole structure 12, and arranged in alternating order as previously described. The medial guides 30C, 30D, 30E are configured to extend further outward than in FIG. 2, to a medial side support 31A and are configured as a unitary, one-piece component with the medial side support 31A. Similarly, the lateral guides 30A, 30B are configured to extend further outward than in FIG. 2, to a lateral side support 31B and are configured as a unitary, one-piece component with the lateral side support 31B. When the outer surface of the upper 14 of FIG. 2 is secured to the sole structure 12 during thermoforming, the medial side support 31A will extend along and against the medial side 14B of the upper 14 to also function as a support at the medial side of the upper 14, and the lateral side support 31B will extend along and against the lateral side 14A of the upper 14 to also function as a support at the lateral side of the upper 14.

Figure 21:
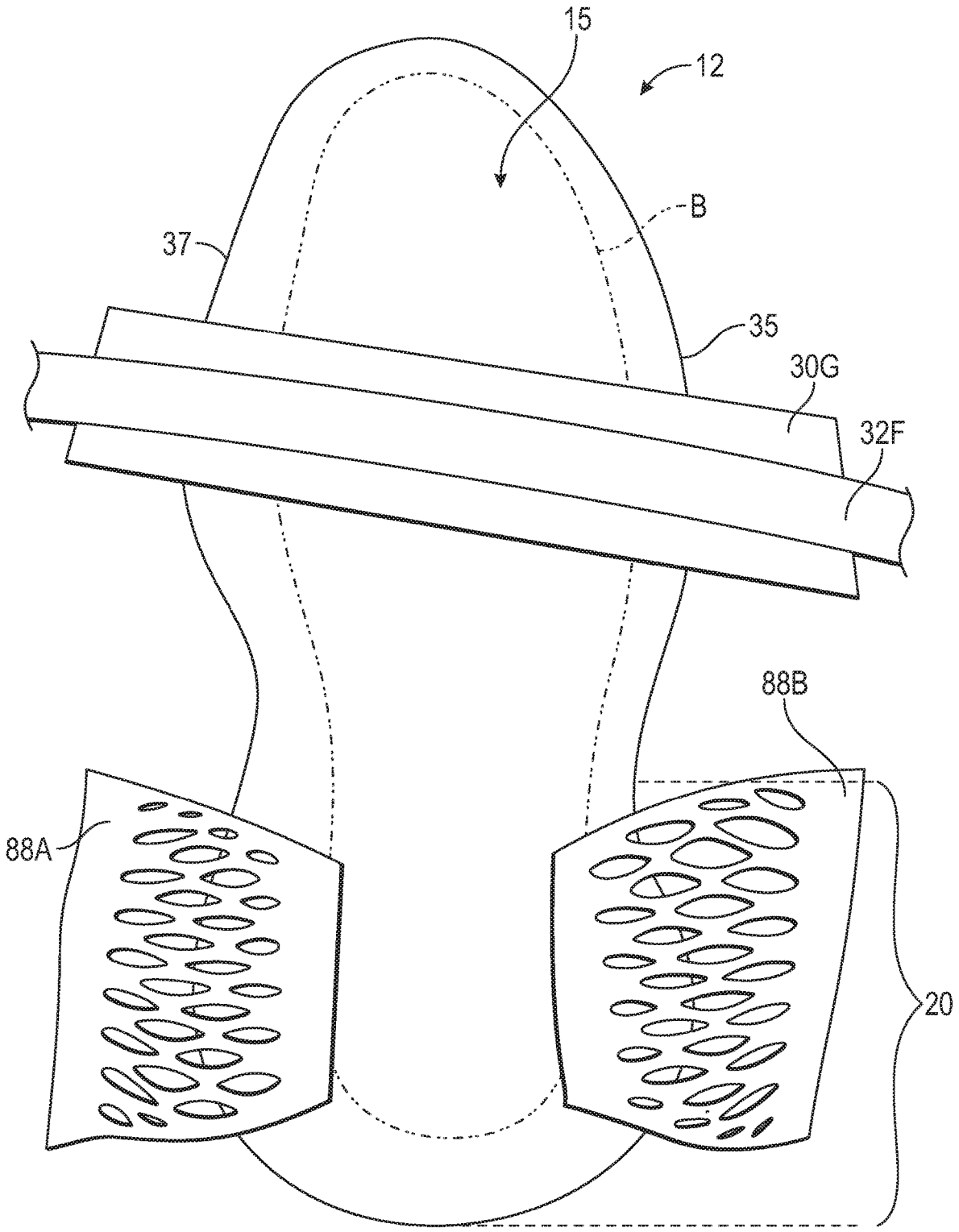
FIG. 21 is a top view of an assembly of a sole structure with guides and tensioning components.

FIG. 21 shows the sole structure 12 in its preform state with just a single guide 30G that is adhered to and extends completely across the inner surface 15 of the sole structure 12 and beyond the lateral edge 35 and the medial edge 37. A single tensioning component 32F is positioned on the inner surface of the guide 30G and will extend along the medial side and the lateral side of the upper 14 in a passage formed between the outer surface of the upper 14 and the inner surface of the guide 30G. The portions of the guide 30G extending beyond the edges 35, 37 may be secured to the upper 14 but only around the tensioning component to maintain a passage for the tensioning component between the guide and the upper. There is no fixed end of the tensioning component 32F as no portion of it is adhered to the inner surface 15. Two side supports 88A and 88B are adhered to the inner surface 15 near the medial and lateral sides in the heel region 20, and can be adhered to the upper 14 when the sole structure is thermoformed to the upper 14.

Figure 22:
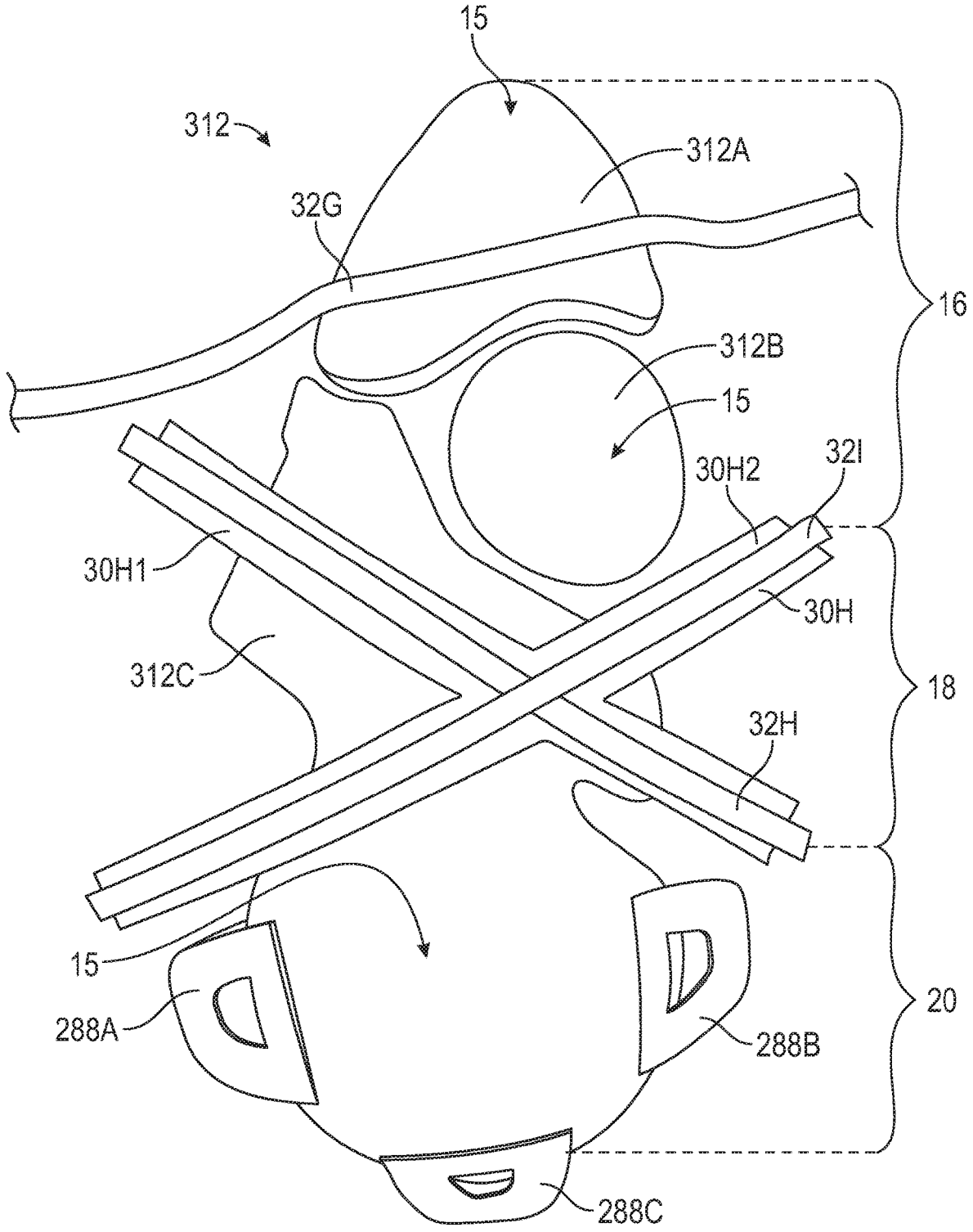
FIG. 22 is a top view of an assembly of a sole structure with guides and tensioning components.

FIG. 22 shows a multi-piece sole structure 312, including sole structure portions 312A, 312B, 312C, and in its preform state. Together, the portions 312A, 312B, 312C of the sole structure include an inner surface 15 that can be secured to the upper 14 with adhesive. A tensioning component 32G is secured directly to the portion 312A with the adhesive layer 56 that is disposed thereon during manufacturing, and so does not slide or move relative to the sole structure 312. A guide 30H is adhered to the inner surface 15 of the portion 312C in the midfoot region 18. The guide 30H has two portions 30H1 and 30H2 defining an X-shape. Because adhesive is placed only on the inner surface 15 and is not placed on the upper 14 or on the inner surface of the guide 30H, two intersecting passages are formed between the upper 14 and the two crossing portions 30H1 and 30H2 of the guide 30H. A first tensioning component 32H is positioned on one of the portions 30H1 and extends along the portion 30H1 and is disposed in one of the two intersecting passages when the sole structure 312 is secured to the upper 14. A second tensioning component 32I is positioned on the other portion 30H2, crosses over the first tensioning component 32H, and extends along the portion 30H2 so that it disposed in another of the two intersecting passages when the sole structure 312 is secured to the upper 14. Multiple supports 288A, 288B, 288C are adhered or otherwise secured to the inner surface 15 of the portion 312C near the medial and lateral sides and the rear in the heel region 20, and can be adhered to the upper 14 when the sole structure 312 is thermoformed to the upper 14.

Figure 23:
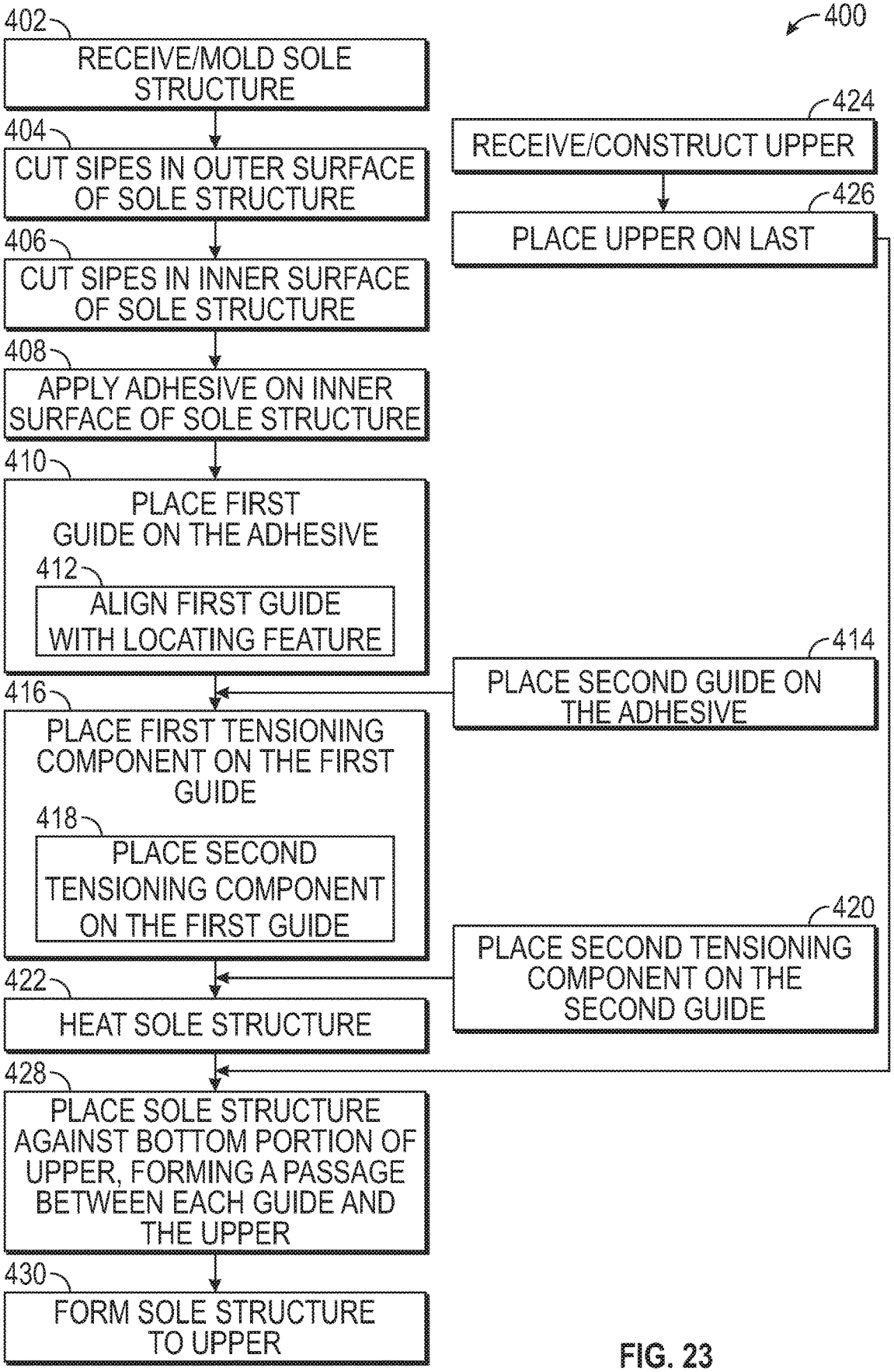
FIG. 23 is a flowchart of a method of manufacturing an article of footwear with a sole structure formed to an upper.

FIG. 23 is a flowchart showing the steps of a method 400 of manufacturing articles of footwear with the various sole structures and other components disclosed herein. For purposes of discussion, the method 400 will refer to sole structure 12 where applicable, but also applies to other ones of the sole structures disclosed herein. The method begins with step 402, in which the preform sole structure 12 is received in its preform state or is molded to achieve its preform state. If the sole structure 12 is a multi-material sole structure as described herein, molding the preform sole structure 12 to achieve its preform shape may include molding a first preform and a second preform, each preform corresponding to a different one of a first material and a second material, such as for the two layers indicated by the boundary B in FIG. 8, and may be created, for example, through injection or compression molding.

The first and second preforms may then be placed in an intermediate mold together, so that the first preform is in contact with the second preform. Heat is then supplied to the mold for a predetermined period of time. In one embodiment, the mold may be heated at a temperature of approximately 130° C. for approximately 15-20 minutes. This heating may cause first and second preforms to partially expand and fill the internal mold cavity and spill into any coupled molding overflow chambers. It is to be appreciated that the specific temperature and time period used to form the sole structure preform in the mold can be varied, in known fashion, depending on the particular ethylene-vinyl acetate (EVA), or other material, used. After this heating step is complete, the mold is opened, and the sole structure preform may further expand in a known fashion after it is removed from the mold.

After the sole structure preform has stabilized and cooled to ambient temperature, the sole structure preform then may undergo a subsequent compression molding step in a second mold. This second mold may have an internal volume that is less than a volume of the cooled sole structure preform. Thus, when the preform is compression molded, it may be physically compressed to a smaller volume when the mold is closed. The second mold may then be heated for a predetermined period of time. In certain embodiments, the second mold may be heated to approximately 140° C. for approximately 15 minutes, thereby forming a preform sole structure of the desired size/shape. The specific temperatures and time periods used to heat the second mold can be varied, in known fashion, depending on the particular EVA, or other material, used.

While the second mold is still closed, it is cooled, allowing sole structure to fully cure and stabilize. In certain embodiments, the second mold is cooled in a closed condition for approximately 15 minutes until the temperature of second mold is below approximately 35° C. Following this, the mold may be opened and the sole structure removed.

Following receiving the preform sole structure 12 in its preform state or molding the preform sole structure to achieve its preform state as described in step 402, the method 400 proceeds to step 404 in which sipes 21A, 21B may be cut into the outer surface 23 of the preform sole structure 12. In some embodiments, such as with the sole structure 12 of FIG. 6, sipes 21C are cut in the inner surface 15 of the sole structure in step 406. Next, in step 408, adhesive 56 may be applied to the inner surface 15. At least a first guide such as guide 30C is placed on the adhesive 56 at the inner surface 15 in step 410. This may include a sub-step 412, aligning the first guide with a locating feature 50C on the surface, as described with respect to FIG. 9. In some embodiments, only a single guide is used. In other embodiments, the method 400 also includes step 414, placing a second guide such as guide 30A on the adhesive 56 at the inner surface 15.

Next, in step 416, tensioning components are placed on the guides. This includes placing a first tensioning component on a first guide, such as tensioning component 32C placed on guide 30C in FIG. 12. In some embodiments, step 416 may include sub-step 418, placing a second tensioning component on the first guide, such as second tensioning component 32I placed on guide 30H in addition to first tensioning component 32H in FIG. 22. Alternatively or in addition, the method 400 may include step 420, placing a second tensioning component on a second guide, such as second tensioning component 32A placed on second guide 30A.

Before or after the components are stacked on the sole structure as described in steps 410-420, the sole structure may be heated in step 422 to soften it sufficiently for thermoforming. An upper 14 is received in an already constructed state or is constructed in step 424. The upper 14 is then placed on a last 62 in step 426. In step 428, the sole structure 12 is then placed against the outer surface of the bottom portion of the upper 14, forming a passage between each guide and the upper as described herein, with the tensioning components movable in the passages, as described herein. In step 430, the sole structure 12 is then formed to the upper 14 such as by vacuum forming and using the sheet 80 as described in FIG. 16.

Accordingly, by including a guide and tensioning component between the preform sole structure and the upper before forming the sole structure to the upper, the tensioning component is able to move relative to the sole structure and the upper along the guide to conform the sole structure around the upper and a foot disposed therein. The advantages of the preform sole structure, such as the ability to layer materials, the ease of siping, and the ability to roll adhesive on the relatively planar inner surface enabling a relatively manufacturing process to be combined with the adjustable, conforming fit of the sole structure.

The following Clauses provide example configurations of an article of footwear, and a method of manufacturing disclosed herein.

Clause 1: An article of footwear comprising: a sole structure having an inner surface; a guide secured to the inner surface of the sole structure; an upper having a bottom, an outer surface of the bottom secured to the inner surface of the sole structure around the guide with the guide between the bottom of the upper and the sole structure, the upper and the guide forming a passage; and a tensioning component extending along the guide in the passage, and extending out of the passage at at least one of a medial side or a lateral side of the upper, the tensioning component movable in the passage relative to the upper and the guide in response to an increase in tension in the tensioning component to flexibly conform the sole structure to a foot disposed in the upper.

Clause 2: The article of footwear of Clause 1, wherein an outer surface of the guide is adhered to a first portion of the inner surface of the sole structure, and the outer surface of the upper is adhered to a second portion of the inner surface of the sole structure and is not adhered to an inner surface of the guide at the passage.

Clause 3: The article of footwear of Clause 1 or Clause 2, wherein: the sole structure has a base portion, a medial side wall portion at a medial side of the base portion that extends upward from the base portion along the medial side of the upper, and a lateral side wall portion at a lateral side of the base portion that extends upward from the base portion along the lateral side of the upper; and the guide extends along the inner surface of the sole structure at the base portion and at at least one of the medial side wall portion or the lateral side wall portion.

Clause 4: The article of footwear of any of Clauses 1-3, wherein the upper is configured as a strobel-less bootie or sock.

Clause 5: The article of footwear of any of Clauses 1-4, further comprising: an adhesive layer disposed on the inner surface of the sole structure and securing the guide and the upper to the inner surface of the sole structure.

Clause 6: The article of footwear of any of Clauses 1-5, wherein the guide defines an X-shape, two intersecting passages are formed between the guide and the bottom of the upper, the tensioning component is a first tensioning component disposed in one of the two intersecting passages, and the article of footwear further comprising: a second tensioning component extending along the guide in another of the two intersecting passages and crossing over the first tensioning component.

Clause 7: The article of footwear of any of Clauses 1-6, wherein the sole structure has a plurality of sipes extending partway through the sole structure at an outer surface of the sole structure, and the sipes are adapted to splay open when the tensioning component is tensioned.

Clause 8: The article of footwear of Clause 7, wherein the sole structure includes a plurality of sipes extending partway through the sole structure at the inner surface of the sole structure, the sipes at the inner surface of the sole structure offset from and alternating with the sipes at the outer surface of the sole structure, and the sipes at the inner surface of the sole structure adapted to at least partially close when the tensioning component is tensioned.

Clause 9: The article of footwear of any of Clauses 1-5, wherein the guide is a first guide, the passage is a first passage, the tensioning component is a first tensioning component having a fixed end fixed to the inner surface of the sole structure, the first tensioning component extending along the first guide in the first passage from the fixed end and extending out of the passage at the medial side of the upper; and the article of footwear further comprising: a second guide secured to the inner surface of the sole structure, the upper and the second guide forming a second passage; and a second tensioning component having a fixed end fixed to the inner surface of the sole structure, the second tensioning component extending along the second guide in the second passage from the fixed end and extending out of the passage at the lateral side of the upper.

Clause 10: The article of footwear of Clause 9, wherein: the fixed end of the first tensioning component is fixed to the sole structure nearer to a lateral edge of the sole structure than a medial edge of the sole structure; and the fixed end of the second tensioning component is fixed to the sole structure nearer to the medial edge than the lateral edge.

Clause 11: The article of footwear of Clause 9 or Clause 10, wherein the first guide and the second guide are spaced apart from one another on the inner surface of the sole structure in a longitudinal direction of the sole structure.

Clause 12: The article of footwear of Clause 11, wherein: the first guide is one of a plurality of medial guides, each secured to the inner surface of the sole structure, and each forming a passage with the upper; the second guide is one of a plurality of lateral guides, each secured to the inner surface of the sole structure, and each forming a passage with the upper; the medial guides are arranged in alternating order with the lateral guides; the first tensioning component is one of a plurality of medial tensioning components each having a fixed end fixed to the sole structure nearer the lateral edge of the sole structure than the medial edge of the sole structure, and each extending in one of the passages along one of the medial guides from the fixed end, and extending out of the one of the passages at the medial side of the upper; and the second tensioning component is one of a plurality of lateral tensioning components each having a fixed end fixed to the sole structure nearer the medial edge of the sole structure than the lateral edge of the sole structure, and each extending in one of the passages along one of the lateral guides from the fixed end, and extending out of the one of the passages at the lateral side of the upper.

Clause 13: The article of footwear of Clause 12, wherein: the medial guides extend on the medial side of the upper to a medial side support and are configured as a unitary, one-piece component with the medial side support; and the lateral guides extend on the lateral side of the upper to a lateral side support and are configured as a unitary, one-piece component with the lateral side support.

Clause 14: A method of manufacturing an article of footwear, the method comprising: placing an upper on a last; applying adhesive on an inner surface of a sole structure; placing a guide on the adhesive on the inner surface of the sole structure; placing a tensioning component on the guide; placing the inner surface of the sole structure against an outer surface of the upper to secure the sole structure to the upper with the adhesive, with a passage formed by the upper and the guide, and with the tensioning component in the passage.

Clause 15: The method of Clause 14, wherein the inner surface of the sole structure is substantially planar when the adhesive is placed on the inner surface of the sole structure, and the adhesive is placed on the inner surface of the sole structure by rolling the adhesive on the inner surface of the sole structure.

Clause 16: The method of Clause 15, further comprising: heating the sole structure before placing the inner surface of the sole structure against the outer surface of the upper; and forming the sole structure to the outer surface of the upper with the sole structure partially wrapping around and conforming to the upper at a medial side of the upper and at a lateral side of the upper, such that the inner surface of the sole structure is nonplanar.

Clause 17: The method of Clause 16, further comprising: cutting sipes in the outer surface of the sole structure prior to forming the sole structure to the outer surface of the upper; wherein the sipes are adapted to splay open when the sole structure is formed to the upper, and to splay further open in response to an increase in tension in the tensioning component when the upper is removed from the last.

Clause 18: The article of footwear of Clause 17, further comprising: cutting sipes in the inner surface of the sole structure prior to forming the sole structure to the outer surface of the upper; wherein the sipes in the inner surface of the sole structure are adapted to partially close when the sole structure is formed to the upper, and to further close in response to an increase in tension in the tensioning component when the upper is removed from the last.

Clause 19: The article of footwear of Clause 14, wherein placing the guide on the adhesive on the inner surface of the sole structure includes aligning the guide with a locating feature on the inner surface of the sole structure.

Clause 20: The method of Clause 14, wherein the tensioning component is a first tensioning component, and the method further comprising: prior to placing the inner surface of the sole structure against the outer surface of the upper, placing a second tensioning component on the guide, the second tensioning component crossing over the first tensioning component.

Clause 21: The method of Clause 14, wherein placing the tensioning component on the guide includes positioning the tensioning component so that an end of the tensioning component extends off of the guide and onto the inner surface of the sole structure, the end fixed to the sole structure by the adhesive, and the tensioning component extending along the guide from the end and out of the passage at a medial side or a lateral side of the upper.

Clause 22: The method of Clause 21, wherein the guide is a first guide, the passage is a first passage, the tensioning component is a first tensioning component that extends out of the first passage at the medial side of the upper, and the method further comprising: prior to placing the inner surface of the sole structure against the outer surface of the upper, placing a second guide on the adhesive on the inner surface of the sole structure; and placing a second tensioning component on the second guide, the upper and the second guide forming a second passage and the second tensioning component extending off of the second guide to an end on the inner surface of the sole structure, the end of the second tensioning component fixed to the sole structure by the adhesive, the second tensioning component extending along the second guide from the end of the second tensioning component and extending out of the second passage at the lateral side of the upper.

Clause 23: The method of Clause 22, wherein the first guide is one of a plurality of medial guides, each secured to the inner surface of the sole structure, and each extending along the inner surface and forming a passage with the upper; wherein the second guide is one of a plurality of lateral guides, each secured to the inner surface of the sole structure, and each extending along the inner surface of the sole structure and forming a passage with the upper; and the method further comprising: placing the medial guides and the lateral guides on the inner surface of the sole structure so that the medial guides are arranged in alternating order with the lateral guides.

To assist and clarify the description of various embodiments, various terms are defined herein. Unless otherwise indicated, the following definitions apply throughout this specification (including the claims). Additionally, all references referred to are incorporated herein in their entirety.

An "article of footwear", a "footwear article of manufacture", and "footwear" may be considered to be both a machine and a manufacture. Assembled, ready to wear footwear articles (e.g., shoes, sandals, boots, etc.), as well as discrete components of footwear articles (such as a midsole, an outsole, an upper component, etc.) prior to final assembly into ready to wear footwear articles, are considered and alternatively referred to herein in either the singular or plural as "article(s) of footwear".

"A", "an", "the", "at least one", and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range.

The terms "comprising", "including", and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

For consistency and convenience, directional adjectives may be employed throughout this detailed description corresponding to the illustrated embodiments. Those having ordinary skill in the art will recognize that terms such as "above", "below", "upward", "downward", "top", "bottom", etc., may be used descriptively relative to the figures, without representing limitations on the scope of the invention, as defined by the claims.

The term "longitudinal" refers to a direction extending a length of a component. For example, a longitudinal direction of a shoe extends between a forefoot region and a heel region of the shoe. The term "forward" or "anterior" is used to refer to the general direction from a heel region toward a forefoot region, and the term "rearward" or "posterior" is used to refer to the opposite direction, i.e., the direction from the forefoot region toward the heel region. In some cases, a component may be identified with a longitudinal axis as well as a forward and rearward longitudinal direction along that axis. The longitudinal direction or axis may also be referred to as an anterior-posterior direction or axis.

The term "transverse" refers to a direction extending a width of a component. For example, a transverse direction of a shoe extends between a lateral side and a medial side of the shoe. The transverse direction or axis may also be referred to as a lateral direction or axis or a mediolateral direction or axis.

The term "vertical" refers to a direction generally perpendicular to both the lateral and longitudinal directions. For example, in cases where a sole is planted flat on a ground surface, the vertical direction may extend from the ground surface upward. It will be understood that each of these directional adjectives may be applied to individual components of a sole. The term "upward" or "upwards" refers to the vertical direction pointing towards a top of the component, which may include an instep, a fastening region and/or a throat of an upper. The term "downward" or "downwards" refers to the vertical direction pointing opposite the upwards direction, toward the bottom of a component and may generally point towards the bottom of a sole structure of an article of footwear.

The "interior" of an article of footwear, such as a shoe, refers to portions at the space that is occupied by a wearer's foot when the shoe is worn. The "inner side" or "inner surface" of a component refers to the side or surface of the component that is (or will be) oriented toward the interior of the component or article of footwear in an assembled article of footwear. The "outer side", "outer surface", or "exterior" of a component refers to the side or surface of the component that is (or will be) oriented away from the interior of the shoe in an assembled shoe. In some cases, other components may be between the inner side of a component and the interior in the assembled article of footwear. Similarly, other components may be between an outer side of a component and the space external to the assembled article of footwear. Further, the terms "inward" and "inwardly" refer to the direction toward the interior of the component or article of footwear, such as a shoe, and the terms "outward" and "outwardly" refer to the direction toward the exterior of the component or article of footwear, such as the shoe. In addition, the term "proximal" refers to a direction that is nearer a center of a footwear component, or is closer toward a foot when the foot is inserted in the article of footwear as it is worn by a user. Likewise, the term "distal" refers to a relative position that is further away from a center of the footwear component or is further from a foot when the foot is inserted in the article of footwear as it is worn by a user. Thus, the terms proximal and distal may be understood to provide generally opposing terms to describe relative spatial positions.

While various embodiments have been described, the description is intended to be exemplary, rather than limiting and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims.

While several modes for carrying out the many aspects of the present teachings have been described in detail, those familiar with the art to which these teachings relate will recognize various alternative aspects for practicing the present teachings that are within the scope of the appended claims. It is intended that all matter contained in the above description or shown in the accompanying drawings shall be interpreted as illustrative and exemplary of the entire range of alternative embodiments that an ordinarily skilled artisan would recognize as implied by, structurally and/or functionally equivalent to, or otherwise rendered obvious based upon the included content, and not as limited solely to those explicitly depicted and/or described embodiments.

What is claimed is:

1. An article of footwear comprising:

a sole structure having a base portion, a medial side wall portion, a lateral side wall portion, and an inner surface that extends across the medial sidewall portion, the base portion, and the lateral sidewall portion;

an adhesive layer extending across the inner surface of the sole structure;

a guide material secured to a portion of the inner surface of the sole structure via the adhesive layer, the guide extending across the base portion and at least one of the medial sidewall portion and lateral sidewall portion;

a tensioning component at least partially layered on an opposite side of the guide material from the sole structure and further extending beyond the guide material such that the tensioning component contacts the adhesive layer and is directly secured to a portion of the inner surface of the sole structure via the adhesive layer;

an upper having a bottom, a medial side and a lateral side, wherein the medial side wall portion of the sole structure extends upward from the base portion of the sole structure and is in contact with the medial side of the upper, and wherein the lateral side wall portion of the sole structure extends upward from the base portion of the sole structure and is in contact with the lateral side of the upper, and further wherein an outer surface of the medial side, the lateral side, and the bottom of the upper is secured to the inner surface of the sole structure via the adhesive layer around the guide material such that the guide material is positioned between the bottom of the upper and the sole structure and wherein:

the upper is unadhered to the guide material to form a passage therebetween, the tensioning component extends across the guide material and out of the passage at least one of the medial side or the lateral side of the upper, the tensioning component movable in the passage relative to the upper and the guide material in response to an increase in tension in the tensioning component to flexibly conform the at least one of the medial sidewall portion and lateral sidewall portion of the sole structure to a foot disposed in the upper; and the outer surface of the medial side, the lateral side, and the bottom of the upper is secured to the inner surface of the sole structure vis the adhesive layer; and wherein the guide material masks a portion of the adhesive layer from contacting the tensioning component within the passage.

2. The article of footwear of claim 1, wherein an outer surface of the guide material is adhered to a first portion of the inner surface of the sole structure via the adhesive layer, and the outer surface of the upper is adhered to a second portion of the inner surface of the sole structure via the adhesive layer, and the outer surface of the upper is not adhered to an inner surface of the guide material at the passage.

3. The article of footwear of claim 1, wherein the upper is configured as a strobel-less bootie or sock.

4. The article of footwear of claim 1, wherein the guide material defines an X-shape, two intersecting passages are formed between the guide and the bottom of the upper, the tensioning component is a first tensioning component disposed in one of the two intersecting passages, and the article of footwear further comprising:

a second tensioning component extending along the guide material in another of the two intersecting passages and crossing over the first tensioning component.

5. The article of footwear of claim 1, wherein the sole structure has a plurality of sipes extending partway through the sole structure at an outer surface of the sole structure, and the sipes are adapted to splay open when the tensioning component is tensioned.

6. The article of footwear of claim 5, wherein the sole structure includes a plurality of sipes extending partway through the sole structure at the inner surface of the sole structure, the sipes at the inner surface of the sole structure offset from and alternating with the sipes at the outer surface of the sole structure, and the sipes at the inner surface of the sole structure adapted to at least partially close when the tensioning component is tensioned.

7. The article of footwear of claim 1, wherein the guide material is a first guide, the passage is a first passage, the tensioning component is a first tensioning component having a fixed end fixed to the inner surface of the sole structure, the first tensioning component extending along the first guide material in the first passage from the fixed end and extending out of the passage at the medial side of the upper; and the article of footwear further comprising:

a second guide material secured to the inner surface of the sole structure across the base portion and at least one of the medial sidewall portion and lateral sidewall portion, the upper and the second guide forming a second passage; and a second tensioning component having a fixed end fixed to the inner surface of the sole structure, the second tensioning component extending along the second guide material in the second passage from the fixed end and extending out of the passage at the lateral side of the upper.

8. The article of footwear of claim 7, wherein:

the fixed end of the first tensioning component is fixed to the sole structure nearer to a lateral edge of the sole structure than a medial edge of the sole structure; and the fixed end of the second tensioning component is fixed to the sole structure nearer to the medial edge than the lateral edge.

9. The article of footwear of claim 7, wherein the first guide material and the second guide material are spaced apart from one another on the inner surface of the sole structure in a longitudinal direction of the sole structure.

10. The article of footwear of claim 9, wherein:

the first guide material is one of a plurality of medial guides, each secured, via the adhesive layer, to the inner surface of the sole structure across the base portion and the medial sidewall portion, and each forming a passage with the upper;

the second guide material is one of a plurality of lateral guides, each secured, via the adhesive layer, to the inner surface of the sole structure across the base portion and the lateral sidewall portion, and each forming a passage with the upper;

the medial guides are arranged in alternating order with the lateral guides;

the first tensioning component is one of a plurality of medial tensioning components each having a fixed end fixed to the sole structure nearer to a lateral edge of the sole structure than to a medial edge of the sole structure, and each extending in one of the passages along one of the medial guides from the fixed end, and extending out of the one of the passages at the medial side of the upper; and the second tensioning component is one of a plurality of lateral tensioning components each having a fixed end fixed to the sole structure nearer the medial edge of the sole structure than the lateral edge of the sole structure, and each extending in one of the passages along one of the lateral guides from the fixed end, and extending out of the one of the passages at the lateral side of the upper.

11. The article of footwear of claim 10, wherein:

the medial guides extend on the medial side of the upper to a medial side support and are configured as a unitary, one-piece component with the medial side support; and the lateral guides extend on the lateral side of the upper to a lateral side support and are configured as a unitary, one-piece component with the lateral side support.

12. The article of footwear of claim 1, wherein the increase in tension in the tensioning component is operative to flexibly conform the at least one of the medial sidewall portion and lateral sidewall portion of the sole structure inward and upward around the foot.

13. The article of footwear of claim 1, wherein the passage is defined on a first side by the guide material and is defined on an opposite second side by the outer surface of the upper.

* * * * *